US011629891B2

(12) United States Patent
Saito et al.

(10) Patent No.: US 11,629,891 B2
(45) Date of Patent: Apr. 18, 2023

(54) HEAT PUMP SYSTEM

(71) Applicant: Samsung Electronics Co., Ltd, Suwon-si (KR)

(72) Inventors: Masaki Saito, Kanagawa (JP); Takeshi Takahara, Kanagawa (JP); Kimio Koda, Kanagawa (JP); Kazushige Tajima, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 299 days.

(21) Appl. No.: 16/483,378

(22) PCT Filed: Feb. 2, 2018

(86) PCT No.: PCT/KR2018/001455
§ 371 (c)(1),
(2) Date: Aug. 2, 2019

(87) PCT Pub. No.: WO2018/143726
PCT Pub. Date: Aug. 9, 2018

(65) Prior Publication Data

US 2019/0346189 A1 Nov. 14, 2019

(30) Foreign Application Priority Data

Feb. 3, 2017 (JP) ..... JP2017-018636
Jun. 5, 2017 (JP) ..... JP2017-110668

(51) Int. Cl.
*F25B 13/00* (2006.01)
*F25B 41/00* (2021.01)
(Continued)

(52) U.S. Cl.
CPC ..... *F25B 13/00* (2013.01); *F25B 30/02* (2013.01); *F25B 41/00* (2013.01); *F25B 49/022* (2013.01); *F25B 41/20* (2021.01); *F25B 41/24* (2021.01)

(58) Field of Classification Search
CPC ..... F25B 30/02; F25B 49/022; F25B 41/00; F25B 2313/0232; F25B 2313/02322
See application file for complete search history.

(56) References Cited

U.S. PATENT DOCUMENTS 6,357,241 B1 * 3/2002 Dudley ..... F25B 41/22 62/126
9,279,591 B2 3/2016 Takata et al.
2013/0227976 A1 * 9/2013 Yamashita ..... F25B 9/006 62/126

FOREIGN PATENT DOCUMENTS

EP 1643196 B1 2/2008
EP 2784414 A1 10/2014
(Continued)

OTHER PUBLICATIONS

International Search Report dated May 28, 2018 in connection with International Patent Application No. PCT/KR2018/001455, 2 pages.
(Continued)

*Primary Examiner* — Elizabeth J Martin
*Assistant Examiner* — Nael N Babaa

(57) ABSTRACT

The present disclosure relates to a heat pump system comprising an outdoor unit disposed in an outdoor space, a plurality of thermal load units supplied with cool air and hot air, and an intermediate unit disposed between the outdoor unit and the plurality of thermal load units, wherein the intermediate unit is connected to the outdoor unit through refrigerant pipes and connected to the plurality of thermal load units through thermal medium pipes.

13 Claims, 13 Drawing Sheets

(51) Int. Cl.

| | |
|---|---|
| ***F25B 49/02*** | (2006.01) |
| ***F25B 30/02*** | (2006.01) |
| *F25B 41/20* | (2021.01) |
| *F25B 41/24* | (2021.01) |

(56) References Cited

FOREIGN PATENT DOCUMENTS

| | | | |
|---|---|---|---|
| JP | H-08278071 | A | 10/1996 |
| JP | 2006-090683 | A | 4/2006 |
| JP | 2006-194537 | A | 7/2006 |
| JP | 2009-198099 | A | 9/2009 |
| JP | 5241923 | B2 | 7/2013 |
| JP | 2016-008788 | A | 1/2016 |
| JP | 2016-011760 | A | 1/2016 |
| KR | 10-2006-0028629 | A | 3/2006 |
| KR | 10-2012-0083139 | A | 7/2012 |
| KR | 10-1548416 | B1 | 8/2015 |
| KR | 10-1605981 | B1 | 3/2016 |
| WO | 2012/121326 | A1 | 9/2012 |
| WO | 2014/128970 | A1 | 8/2014 |
| WO | 2015/140886 | A1 | 9/2015 |

OTHER PUBLICATIONS

Written Opinion of the International Searching Authority dated May 28, 2018 in connection with International Patent Application No. PCT/KR2018/001455, 7 pages.

Japan Patent Office, "Notice of Reasons for Refusal" dated Feb. 10, 2022, in connection with Japanese Patent Application No. 2017110668, 15 pages.

Notice of Preliminary Rejection dated Apr. 21, 2022, in connection with Korean Application No. 10-2019-7011307, 9 pages.

Korean Intellectual Property Office, "Notice of Patent Allowance," dated Oct. 7, 2022, in connection with Korean Patent Application No. 10-2019-7011307, 4 pages.

* cited by examiner

【Figure 1】
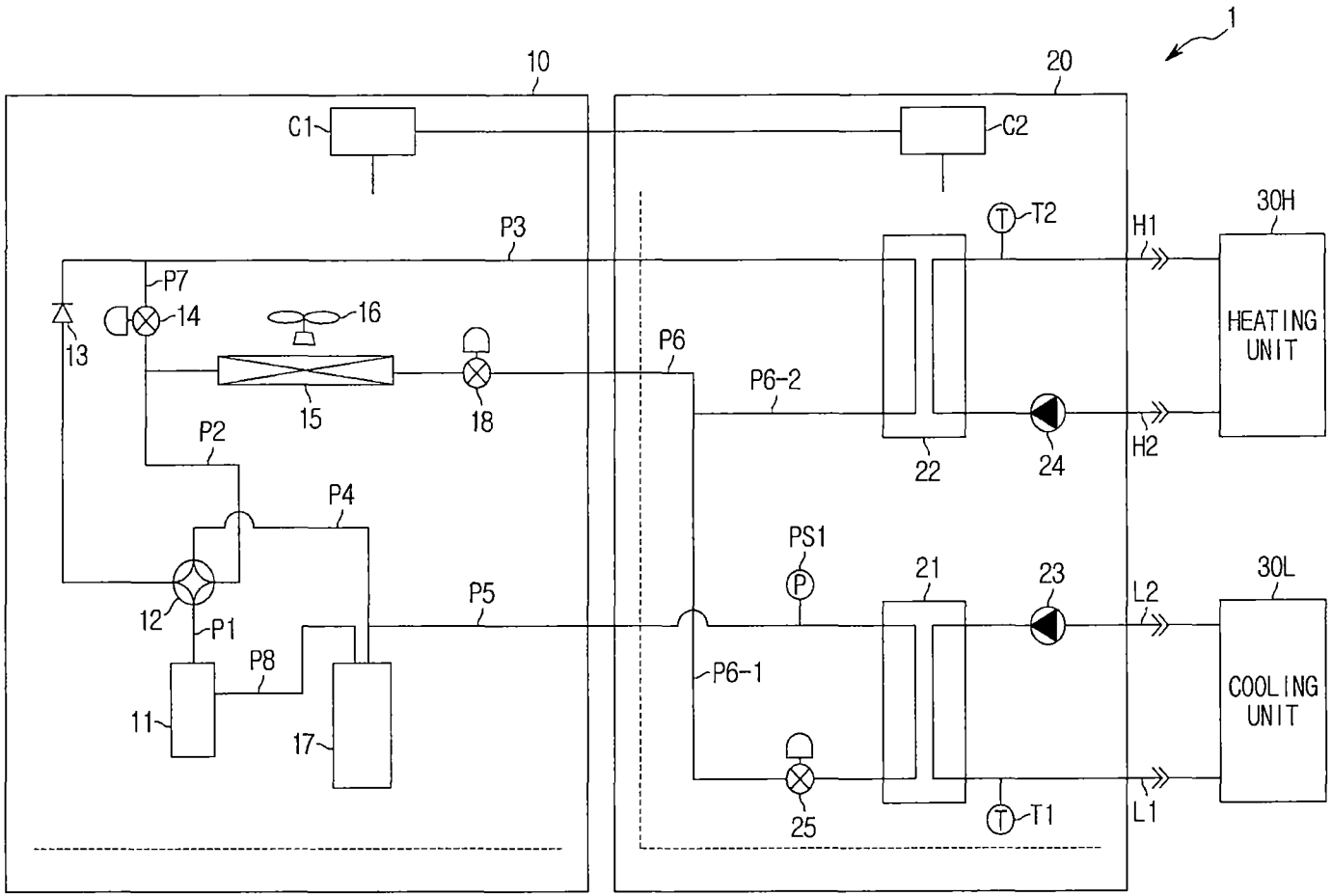

【Figure 2】
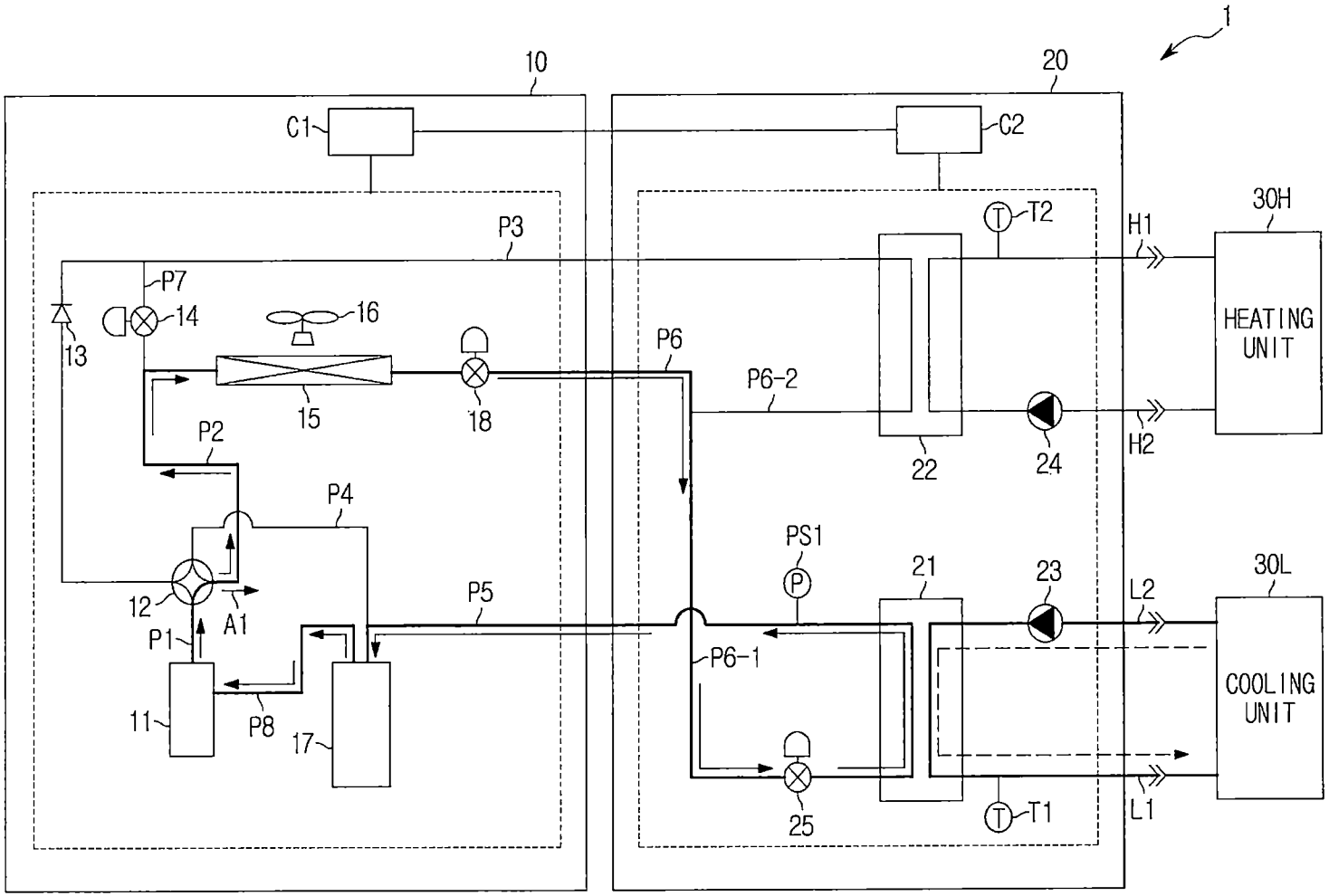

【Figure 3】
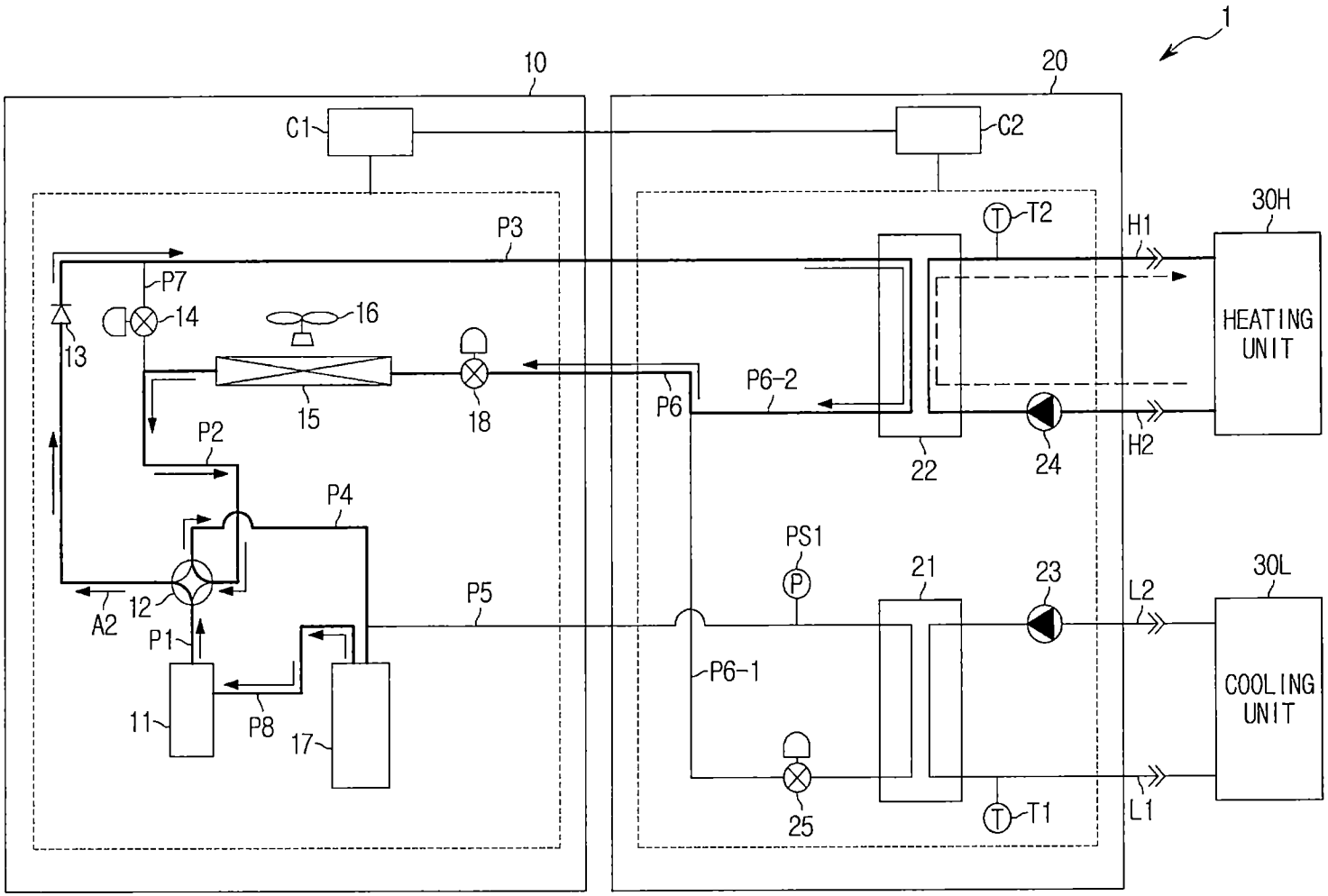

【Figure 4】
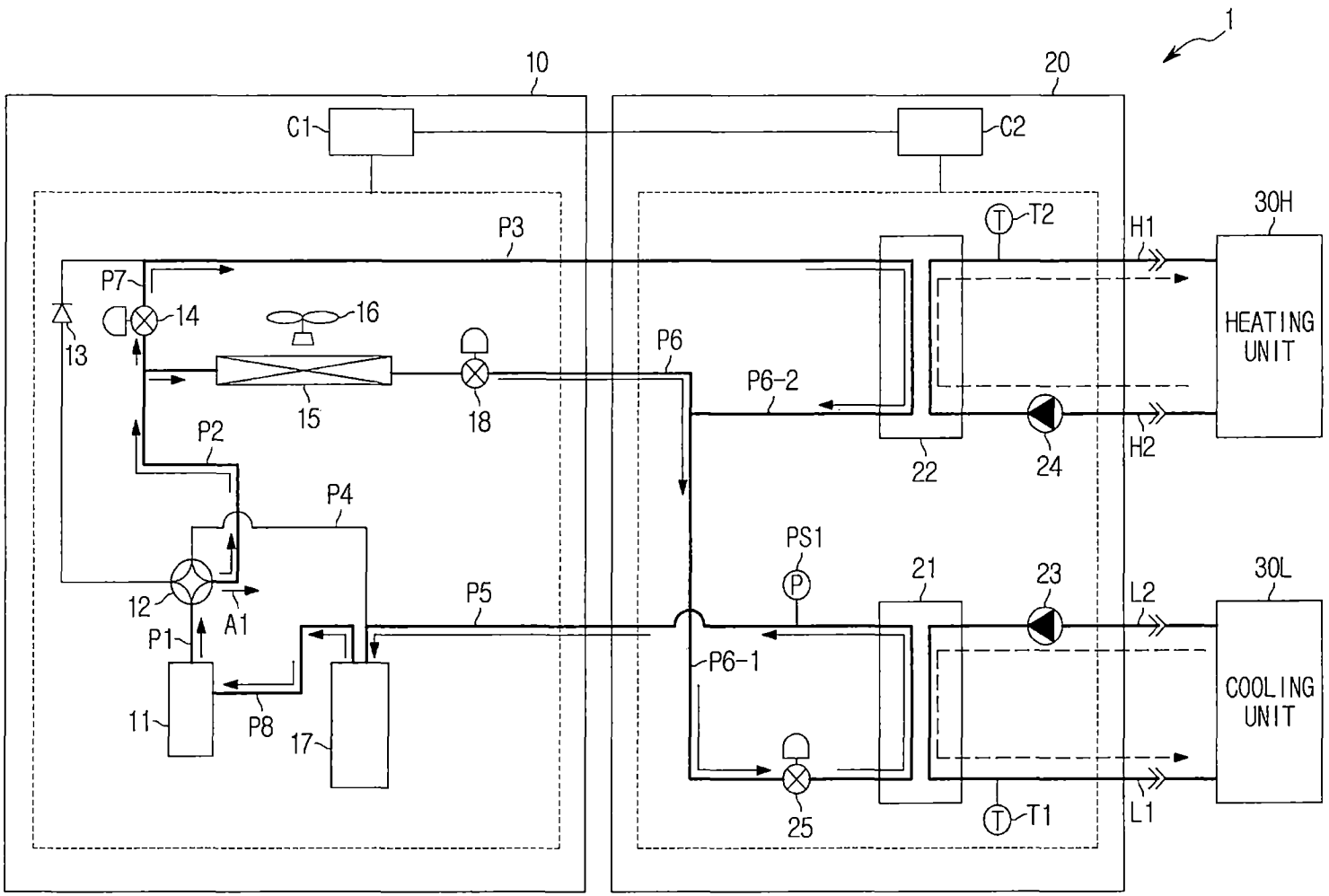

【Figure 5】
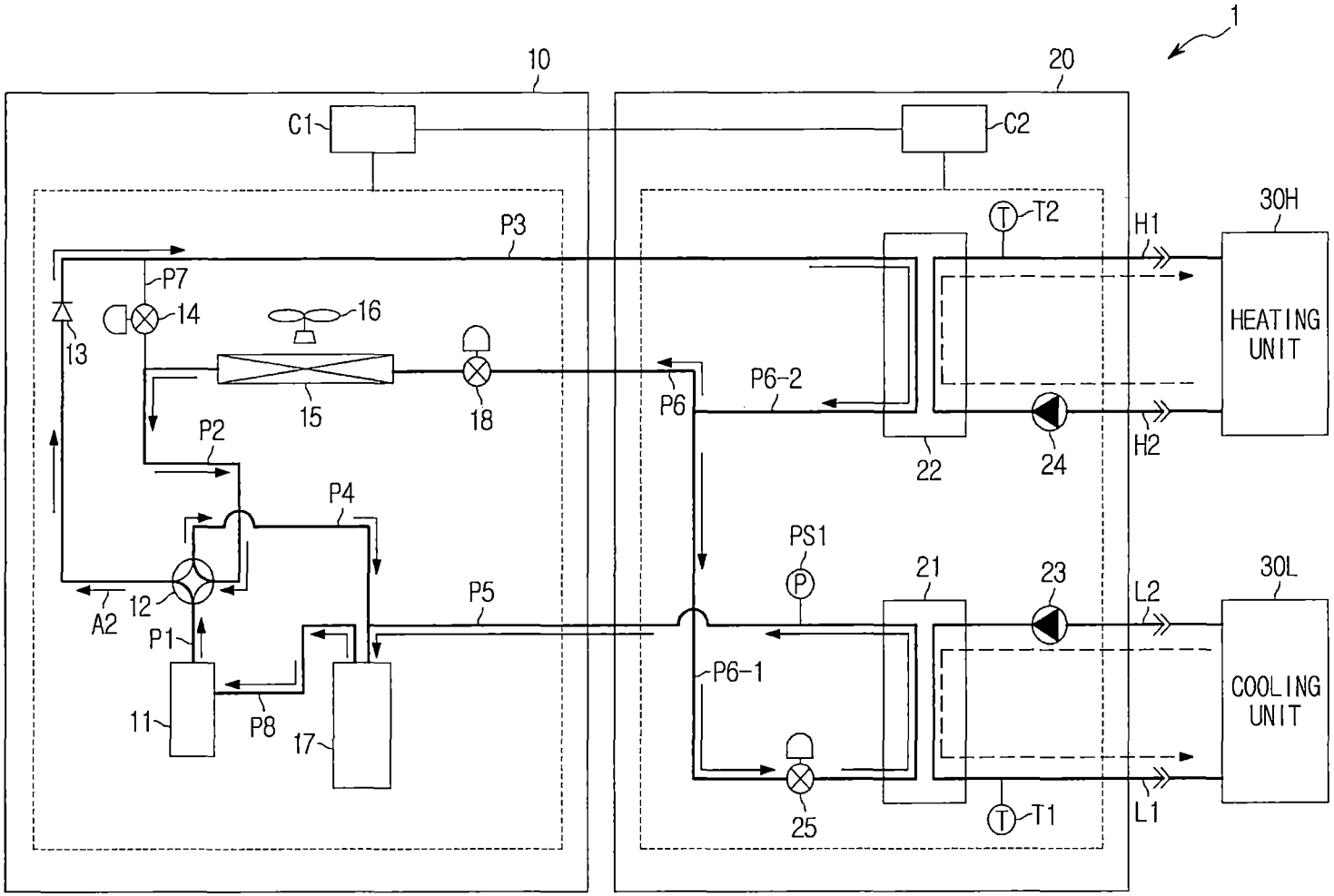

【Figure 6】
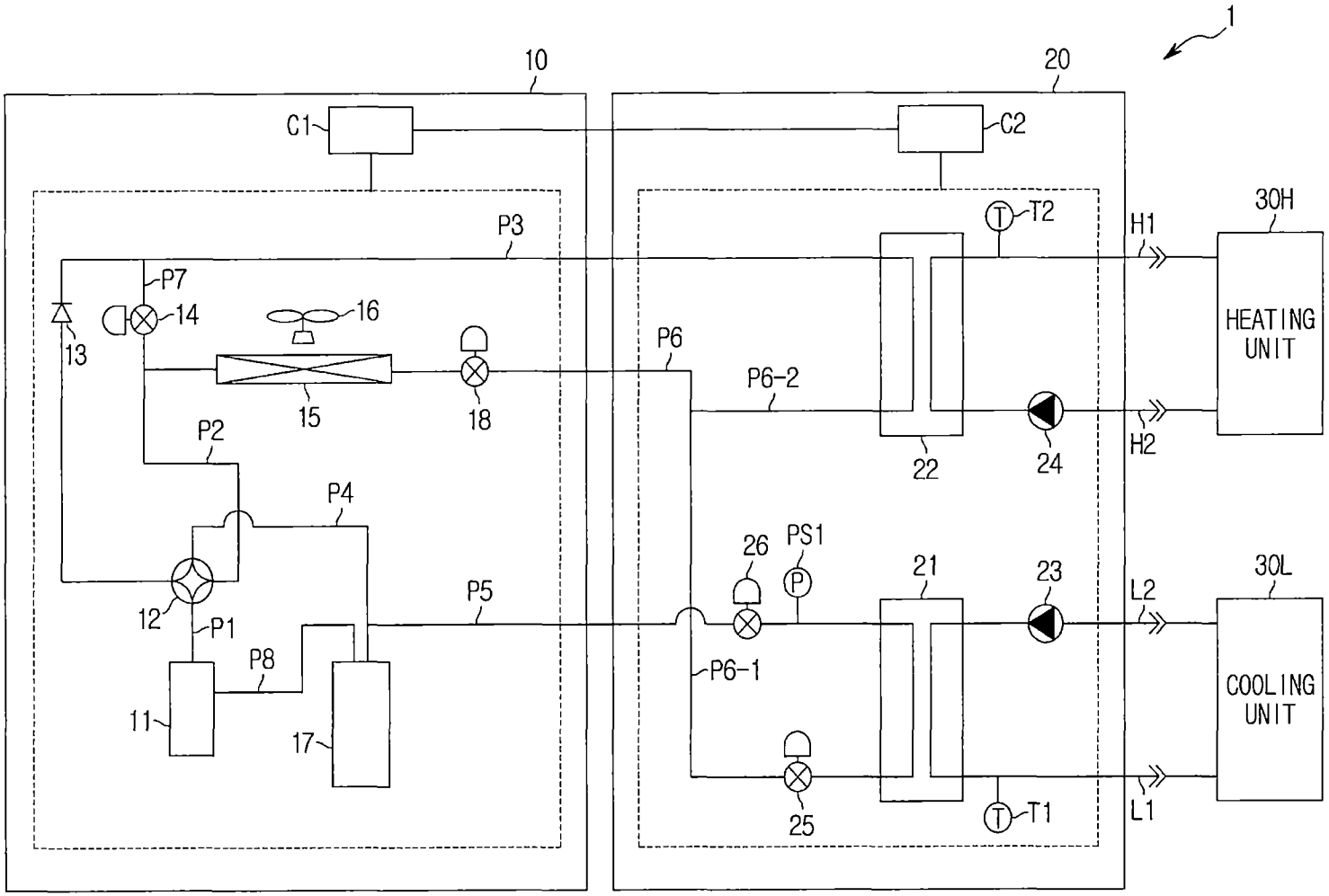

【Figure 7】
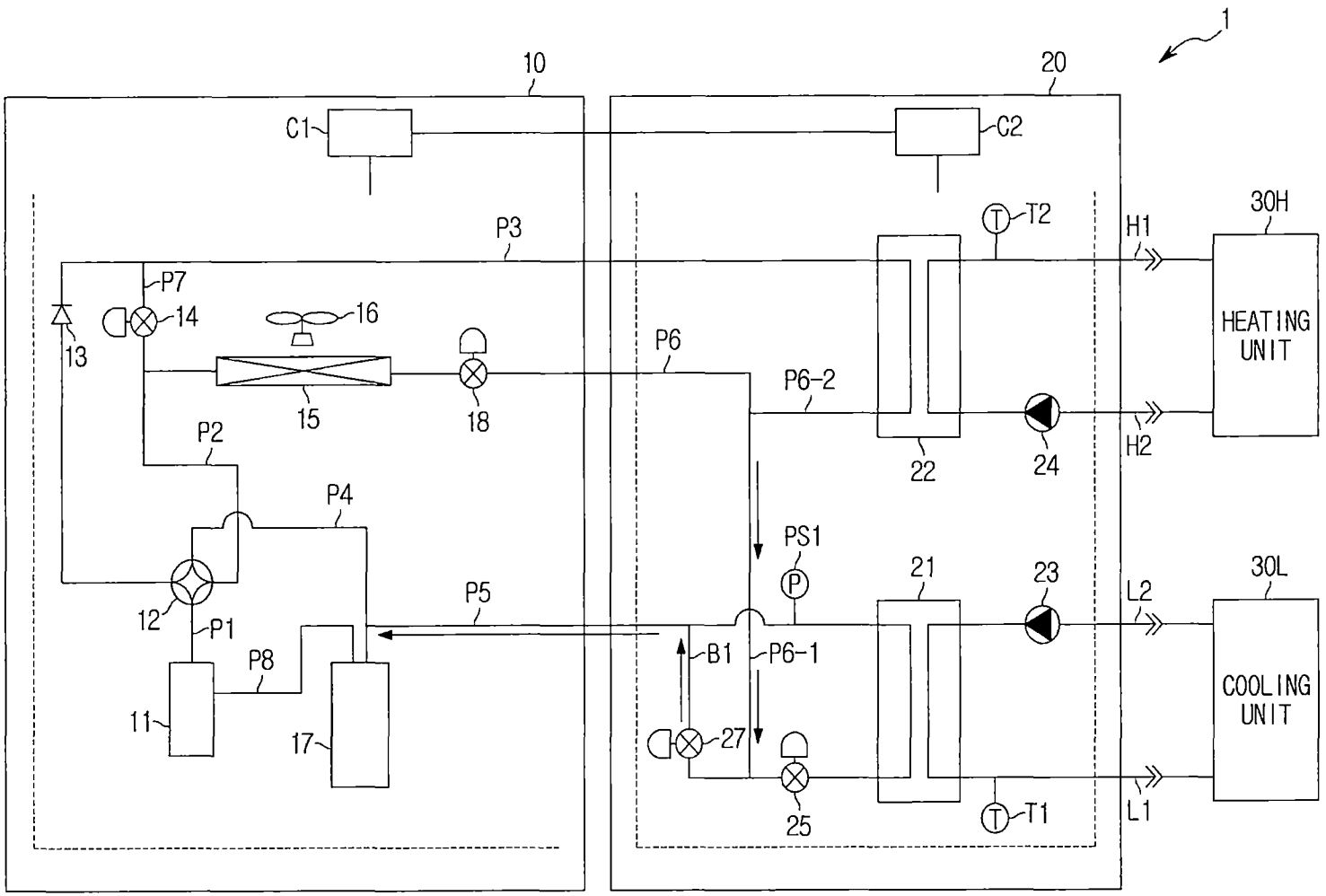

【Figure 8】
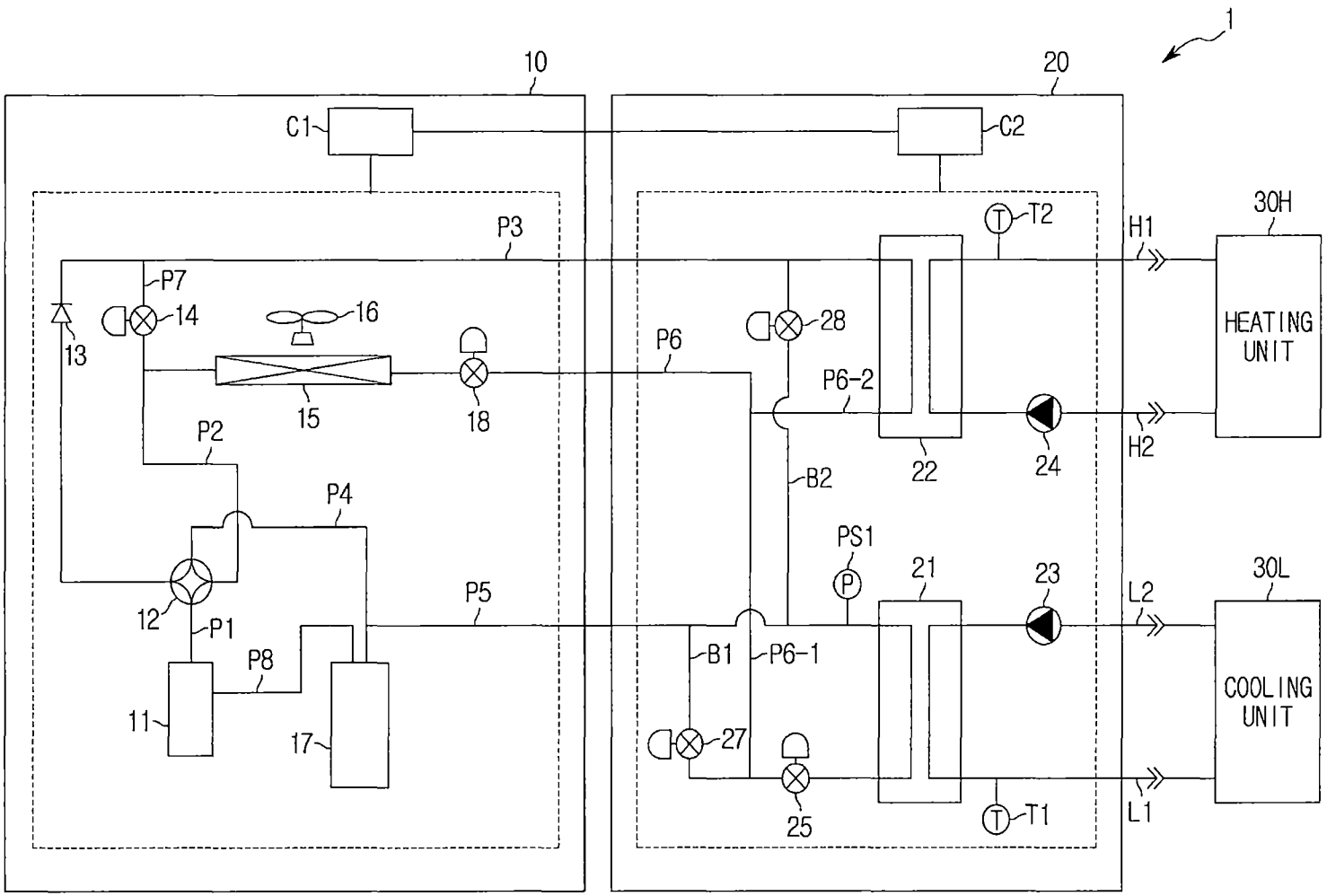

【Figure 9】
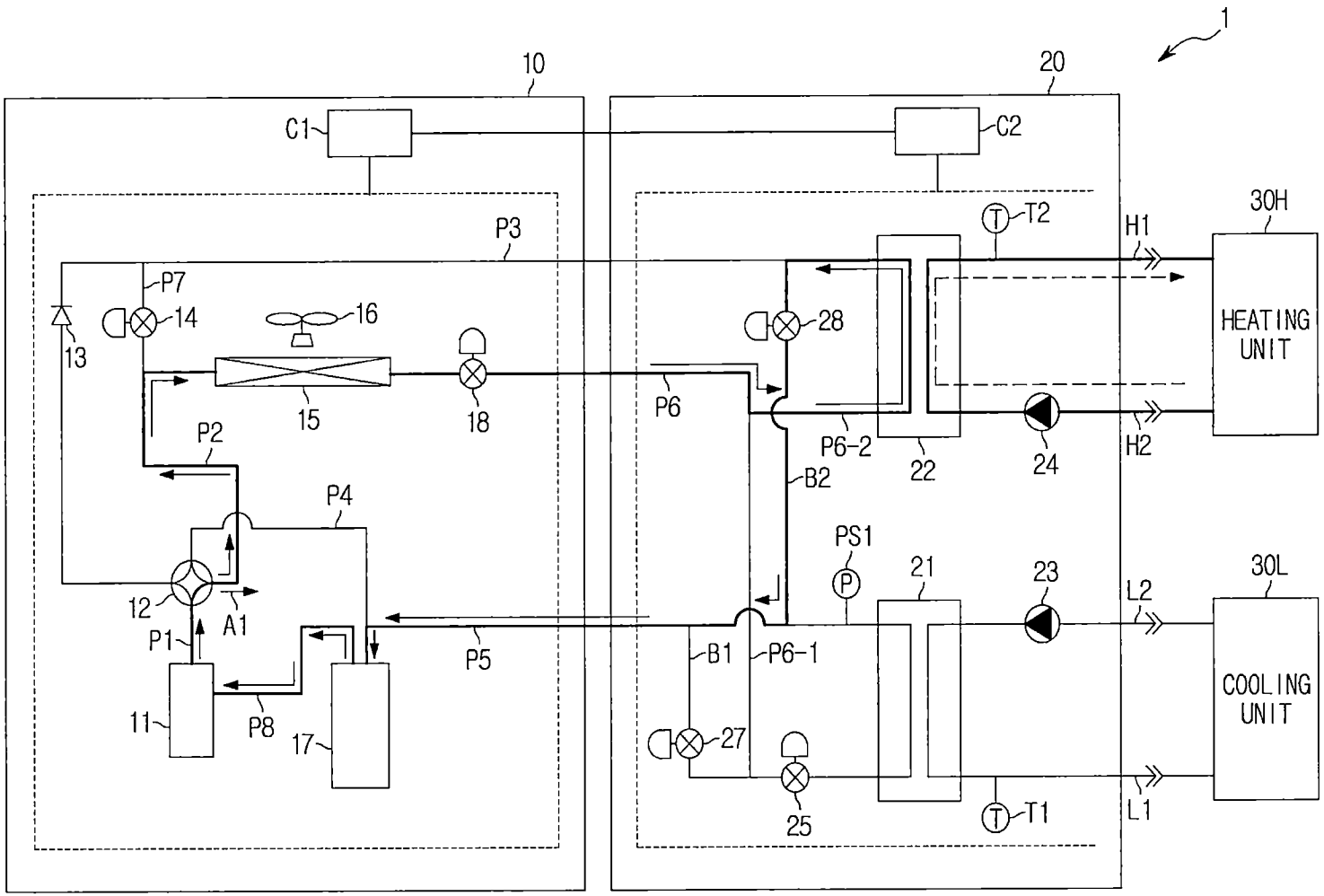

【Figure 10】
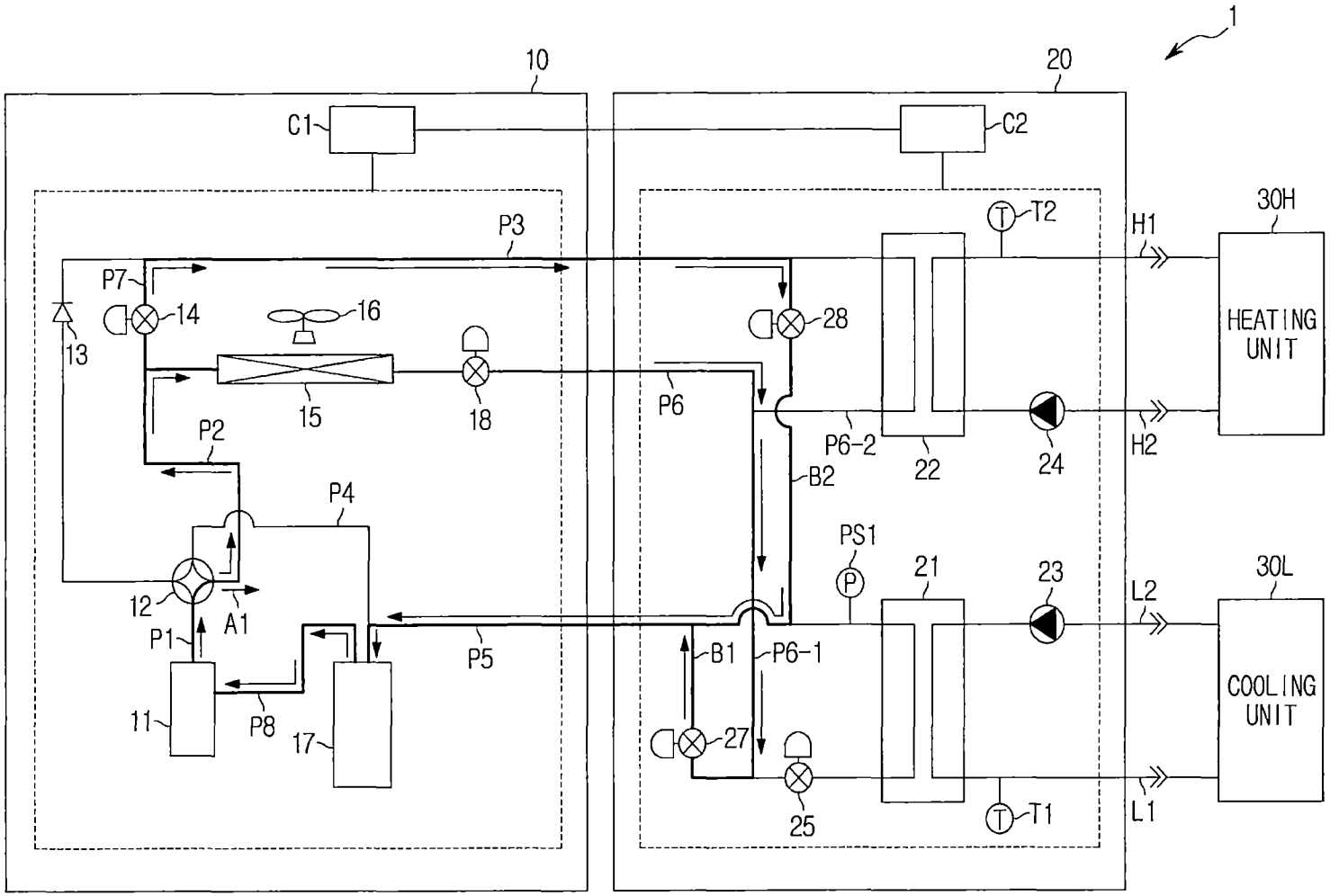

【Figure 11】
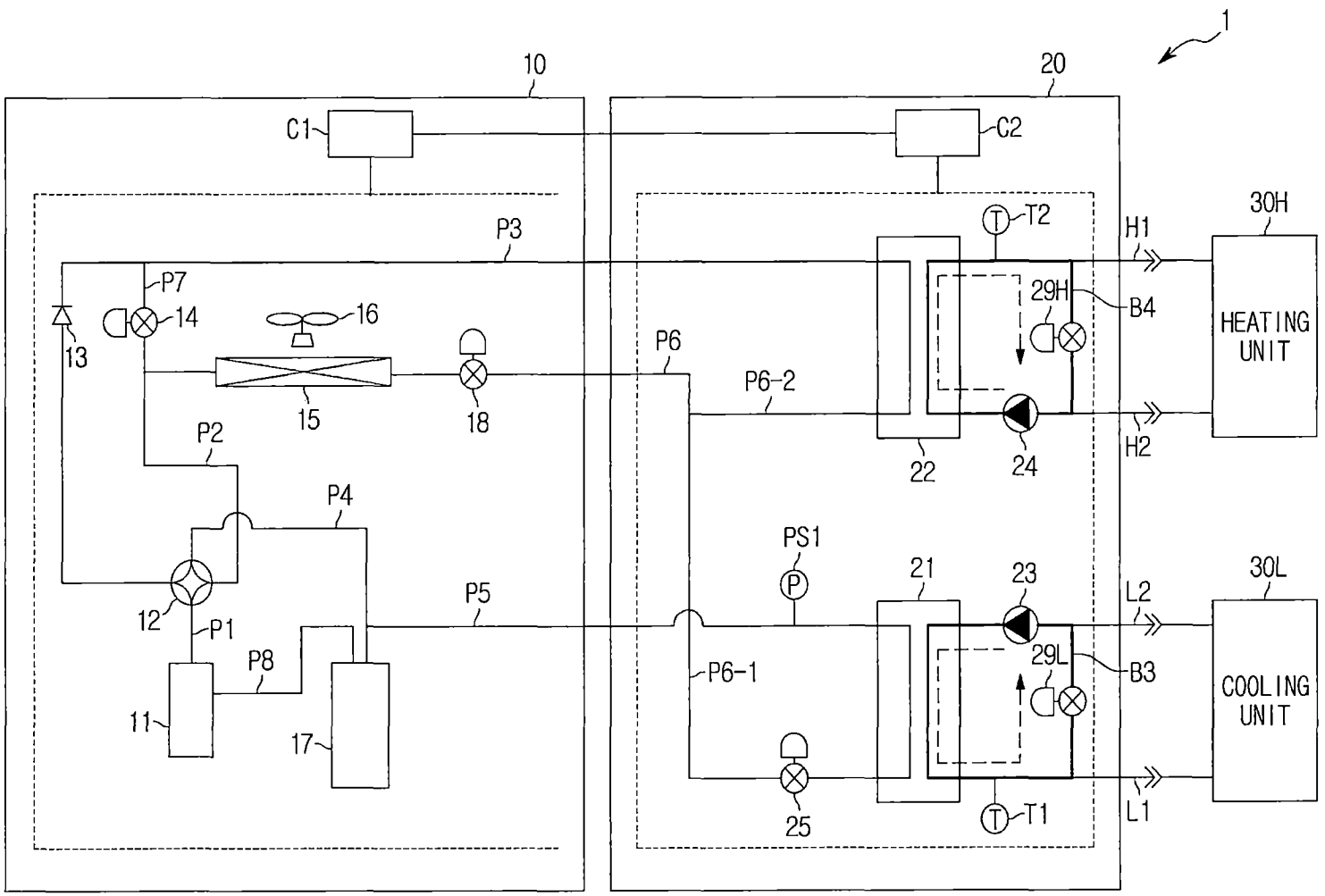

【Figure 12】
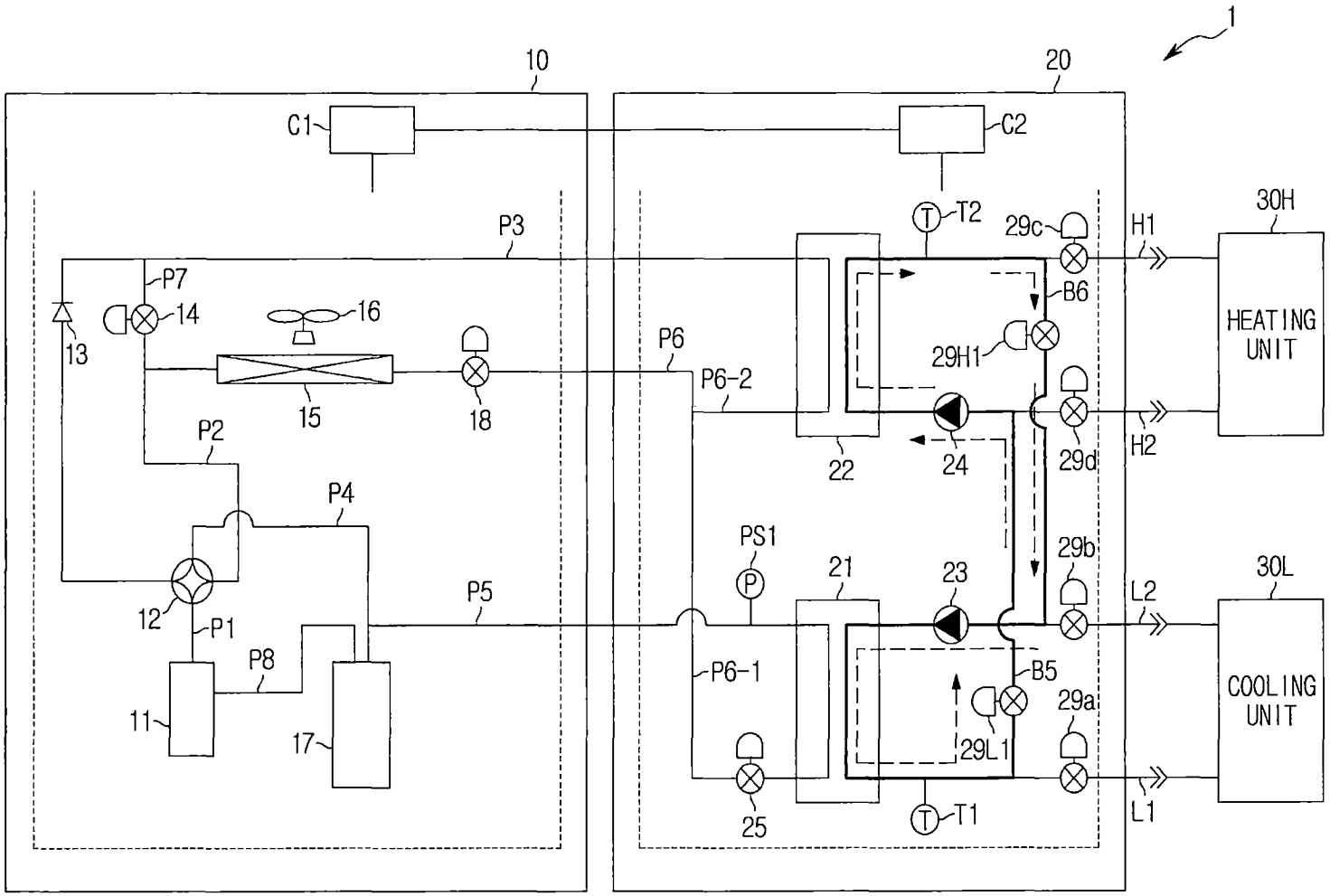

【Figure 13】
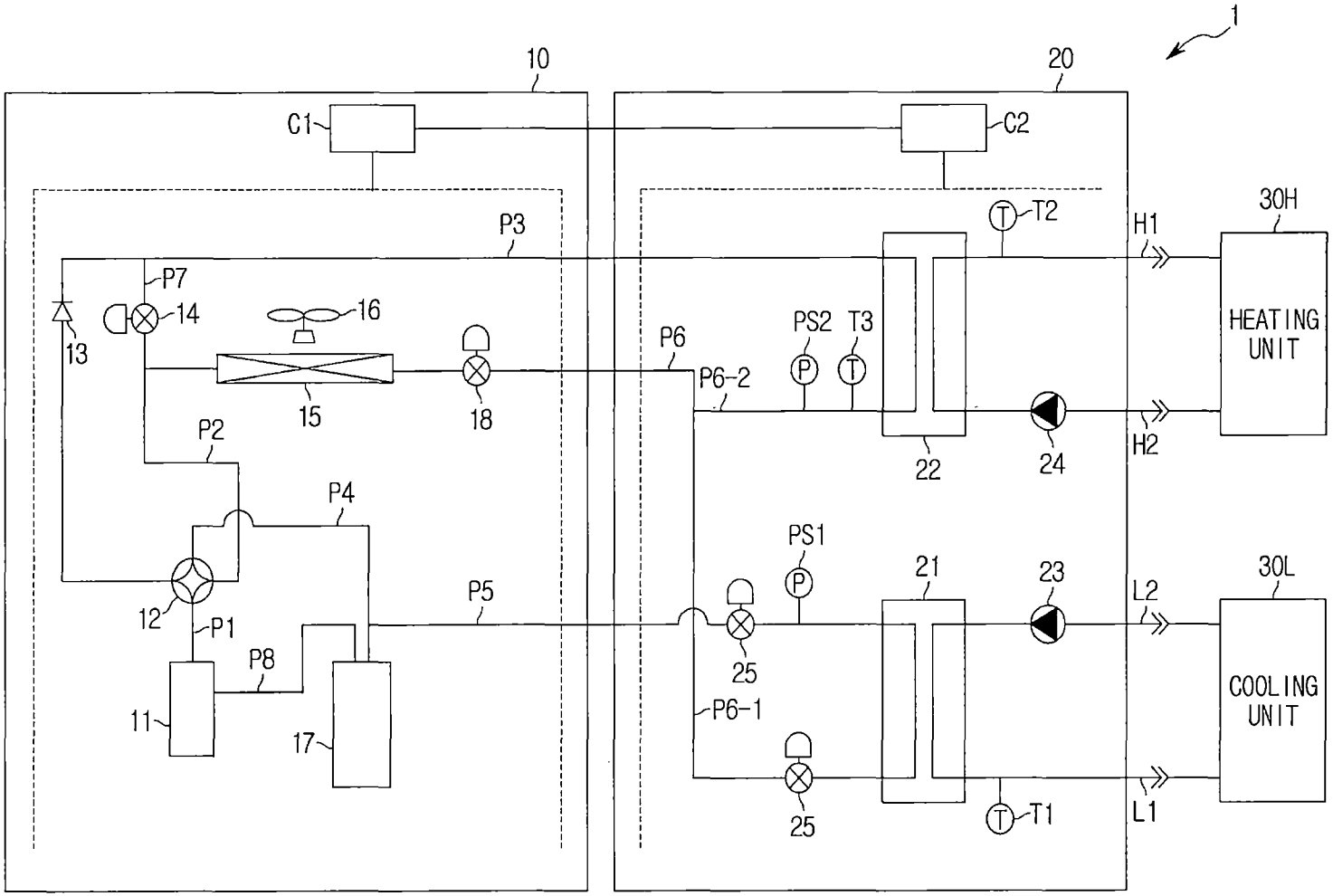

HEAT PUMP SYSTEM

CROSS-REFERENCE TO RELATED APPLICATIONS

The present application is a 371 National Stage of International Application No. PCT/KR2018/001455 filed on Feb. 2, 2018, which claims the benefit of Japanese Patent Application No. 2017-018636 filed on Feb. 3, 2017 and Japanese Patent Application No. 2017-110668 filed on Jun. 5, 2017, the disclosures of which are herein incorporated by reference in their entirety.

BACKGROUND

1. Field

The present disclosure relates to a heat pump system, and more particularly, to a heat pump system including both a cooling unit used for cooling and a heating unit used for heating as a thermal load unit.

2. Description of Related Art

Generally, a heat pump system is for generating cool air and hot air through a refrigerant, and includes a compressor, a condenser, an evaporator, an expansion device, and the like.

The heat pump system also includes an outdoor unit disposed in an outdoor space, a cooling unit used for cooling and a heating unit used for heating, and an intermediate unit for allowing the refrigerant to be distributed and supplied to the cooling unit and the heating unit. Thus, through the refrigerant, cool air is supplied to the cooling unit and hot air is supplied to the heating unit.

SUMMARY

The present disclosure is directed to providing a heat pump system capable of supplying either cool air or hot air or both cool air and hot air with a simpler configuration.

One aspect of the present disclosure provides a heat pump system including an outdoor unit disposed in an outdoor space, a plurality of thermal load units supplied with cool air and hot air, and an intermediate unit disposed between the outdoor unit and the plurality of thermal load units, wherein the intermediate unit is connected to the outdoor unit through refrigerant pipes through which a refrigerant passes, and connected to the plurality of thermal load units through thermal medium pipes through which a thermal medium passes.

The plurality of thermal load units may include a cooling unit to receive and use cool air and a heating unit to receive and use hot air.

The outdoor unit may include a compressor to compress the refrigerant, an outdoor heat exchanger to allow the refrigerant to heat-exchange with outdoor air, a four-way valve to guide the refrigerant discharged from the compressor to any one of the outdoor heat exchanger and the intermediate unit, and an outdoor expansion valve to decompress and expand the refrigerant.

The intermediate unit may include a cooling heat exchanger to exchange heat between the thermal medium transferred from the cooling unit and the refrigerant, a heating heat exchanger to exchange heat between the thermal medium transferred from the heating unit and the refrigerant, and an intermediate expansion valve to decompress and expand the refrigerant.

The heat pump system may further include a first refrigerant pipe to guide the refrigerant discharged from the compressor to the four-way valve, a second refrigerant pipe to guide the refrigerant from the four-way valve to the outdoor heat exchanger, a third refrigerant pipe to guide the refrigerant from the four-way valve to the heating heat exchanger, a fourth refrigerant pipe to guide the refrigerant from the four-way valve to a suction side of the compressor, a fifth refrigerant pipe to guide the refrigerant from the cooling heat exchanger to the suction side of the compressor, a sixth refrigerant pipe connected to the outdoor heat exchanger and branched into two pieces such that one of the two pieces forms a cooling refrigerant pipe connected to the cooling heat exchanger and the other forms a heating refrigerant pipe connected to the heating heat exchanger, a seventh refrigerant pipe to connect the second refrigerant pipe and the third refrigerant pipe, and an on-off valve disposed on the seventh refrigerant pipe to allow the refrigerant to selectively flow through the seventh refrigerant pipe.

The heat pump system may further include a fifth refrigerant pipe to guide the refrigerant from the cooling heat exchanger to a suction side of the compressor, a pressure sensor to detect a pressure at a refrigerant outlet side of the cooling heat exchanger, and a refrigerant flow rate regulating valve disposed on the fifth refrigerant pipe and whose opening degree is controlled such that a pressure detected by the pressure sensor becomes a value within a set range.

The heat pump system may further include a fifth refrigerant pipe to guide the refrigerant from the cooling heat exchanger to a suction side of the compressor, a cooling temperature sensor to detect a temperature of the thermal medium cooled through the cooling heat exchanger, a refrigerant bypass pipe branched from the cooling refrigerant pipe and connected to the fifth refrigerant pipe, and a bypass expansion valve disposed on the refrigerant bypass pipe to open a flow passage of the refrigerant bypass pipe when a temperature of the thermal medium detected by the cooling temperature sensor is lower than a set threshold value.

The heat pump system may further include a defrost bypass pipe having one end connected to a third refrigerant pipe guiding the refrigerant from the four-way valve to the heating heat exchanger and the other end connecting a suction side of the compressor to a fifth refrigerant pipe, and a refrigerant passage switching valve disposed on the defrost bypass pipe to open a flow passage of the defrost bypass pipe when defrosting is required by the outdoor heat exchanger.

The heat pump system may further include a cooling thermal medium supply pipe to supply the thermal medium cooled in the cooling heat exchanger to the cooling unit, a cooling thermal medium recovery pipe to transfer the thermal medium, which has passed through the cooling unit and absorbed heat, to the cooling heat exchanger, a heating thermal medium supply pipe to supply the thermal medium cooled in the heating heat exchanger to the heating unit, and a heating thermal medium recovery pipe to transfer the thermal medium, which has passed through the heating unit and radiated heat, to the heating heat exchanger.

The heat pump system may further include a cooling pump disposed on the cooling thermal medium recovery pipe and a heating pump disposed on the heating thermal medium recovery pipe.

The heat pump system may further include a cooling thermal medium bypass pipe having one end connected to the cooling thermal medium supply pipe and the other end connected to the cooling thermal medium recovery pipe, a heating thermal medium bypass pipe having one end connected to the heating thermal medium supply pipe and the other end connected to the heating thermal medium recovery pipe, a cooling thermal medium bypass valve disposed on the cooling thermal medium bypass pipe to open and close a flow passage of the cooling thermal medium bypass pipe, and a heating thermal medium bypass valve disposed on the heating thermal medium bypass pipe to open and close a flow passage of the heating thermal medium bypass pipe.

The heat pump system may further include a first connection bypass pipe having one end connected to the heating thermal medium supply pipe and the other end connected to the cooling thermal medium recovery pipe, a second connection bypass pipe having one end connected to the cooling thermal medium supply pipe and the other end connected to the heating thermal medium recovery pipe, a first connection bypass valve disposed on the first connection bypass pipe to open and close a flow passage of the first connection bypass pipe, and a second connection bypass valve disposed on the second connection bypass pipe to open and close a flow passage of the second connection bypass pipe.

The heat pump system may further include a cooling thermal medium supply valve disposed on the cooling thermal medium supply pipe to regulate the amount of thermal medium supplied to the cooling unit, a cooling thermal medium recovery valve disposed on the cooling thermal medium recovery pipe to regulate the amount of thermal medium recovered from the cooling unit, a heating thermal medium supply valve disposed on the heating thermal medium supply pipe to regulate the amount of thermal medium supplied to the heating unit, and a heating thermal medium recovery valve disposed on the heating thermal medium recovery pipe to regulate the amount of thermal medium recovered from the heating unit.

The heat pump system may further include a heating refrigerant temperature sensor disposed at a refrigerant outlet side of the heating heat exchanger to detect a temperature of the refrigerant, a heating refrigerant pressure sensor disposed at the refrigerant outlet side of the heating heat exchanger to detect a pressure of the refrigerant, and a refrigerant flow rate regulating valve disposed on the fifth refrigerant pipe and whose opening degree is regulated according to the supercooling degree of the refrigerant outlet side of the heating heat exchanger.

As described above, because in the heat pump system according to an aspect of the present disclosure, an outdoor unit and an intermediate unit are connected to each other through refrigerant pipes and the intermediate unit and thermal load units are connected to each other through thermal medium pipes, the refrigerant pipes are not connected to the heat load units, so that the connection structure of the refrigerant pipes is simplified, thereby facilitating the construction of the heat pump system.

BRIEF DESCRIPTION OF THE DRAWINGS

FIG. 1 is a schematic block diagram of a heat pump system according to an embodiment of the present disclosure.

FIG. 2 is a circuit diagram illustrating flows of a refrigerant and a thermal medium when the heat pump system according to an embodiment of the present disclosure performs a cooling mode.

FIG. 3 is a circuit diagram illustrating flows of the refrigerant and the thermal medium when the heat pump system according to an embodiment of the present disclosure performs a heating mode.

FIG. 4 is a circuit diagram illustrating flows of the refrigerant and the thermal medium when the heat pump system according to an embodiment of the present disclosure performs a cooling-centric mode.

FIG. 5 is a circuit diagram illustrating flows of the refrigerant and the thermal medium when the heat pump system according to an embodiment of the present disclosure performs a heating-centric mode.

FIG. 6 is a view illustrating a case where the heat pump system according to an embodiment of the present disclosure performs low-pressure pressure maintenance control.

FIG. 7 is a view illustrating a case where the heat pump system according to an embodiment of the present disclosure performs cool water temperature decrease prevention control.

FIG. 8 is a view illustrating a case where the heat pump system according to an embodiment of the present disclosure performs defrost control.

FIG. 9 is a view illustrating a case where the heat pump system according to an embodiment of the present disclosure performs a first defrost mode.

FIG. 10 is a view illustrating a case where the heat pump system according to an embodiment of the present disclosure performs a second defrost mode.

FIG. 11 is a view illustrating a case where the heat pump system according to an embodiment of the present disclosure performs freeze prevention control.

FIG. 12 is a view illustrating a case where the heat pump system according to an embodiment of the present disclosure performs water bypass defrost control.

FIG. 13 is a view illustrating a case where the heat pump system according to an embodiment of the present disclosure performs supercooling degree control.

DETAILED DESCRIPTION

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the respective drawings of the present specification represent parts or components that perform substantially the same functions.

The terms used in the present specification are for the purpose of describing the embodiments and are not intended to restrict and/or to limit the present disclosure. For example, the singular expressions herein may include plural expressions, unless the context clearly dictates otherwise. Also, the terms "comprises," "includes" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

The terms "front end," "rear end," "upper portion," "lower portion," "upper end" and "lower end" used in the following description are defined with reference to the drawings, and the shape and position of each component are not limited by these terms.

Hereinafter, a heat pump system according to an embodiment of the present disclosure will be described in detail with reference to the drawings.

FIG. 1 is a schematic block diagram of a heat pump system 1 according to an embodiment of the present disclosure.

As illustrated in FIG. 1, the heat pump system 1 includes an outdoor unit 10 disposed in an outdoor space, thermal load units 30L and 30H disposed in a space or device requiring cool air or hot air, and an intermediate unit 20 disposed between the outdoor unit 10 and the thermal load units 30L and 30H to distribute and supply the cool air and the hot air generated in the outdoor unit 10 to the thermal load units 30L and 30H.

The outdoor unit 10 operates as a heat source that generates cool air and hot air through a refrigerant, including a heat pump cycle and supplies the cool or hot air to the thermal load units 30L and 30H through the intermediate unit 20. The outdoor unit 10 is disposed in an outdoor space, that is, on a roof or a veranda of a building.

The intermediate unit 20 causes the refrigerant transferred from the outdoor unit 10 and a thermal medium transferred from the thermal load units 30L and 30H to exchange heat with each other so that cool air and hot air are transferred to the thermal load units 30L and 30H.

The intermediate unit 20 may be disposed adjacent to the outdoor unit 10 or may be disposed in a space separate from the outdoor unit 10. That is, the intermediate unit 20 may be disposed in an outdoor space together with the outdoor unit 10 or may be disposed in a public space of a building, an upper space of a ceiling, or the like.

The outdoor unit 10 and the intermediate unit 20 are accommodated in separate housings, respectively and connected to each other through refrigerant pipes P1, P2, P3, P4, P5, P6, P7 and P8 that transfer the refrigerant.

The thermal load units 30L and 30H receive and use the cool air and the hot air generated in the outdoor unit 10 through the intermediate unit 20.

The thermal load units 30L and 30H are connected to the intermediate unit 20 through thermal medium pipes L1, L2, H1 and H2 through which the thermal medium passes, and include the cooling unit 30L to receive and use cool air and the heating unit 30H to receive and use hot air.

The cooling unit 30L and the intermediate unit 20 are connected to each other through two of the cooling thermal medium pipes L1 and L2 for transferring the thermal medium. The cooling thermal medium pipes include the cooling thermal medium supply pipe L1 for supplying the thermal medium cooled in a cooling heat exchanger 21 to the cooling unit 30L, and the cooling thermal medium recovery pipe L2 for transferring the thermal medium that has passed through the cooling unit 30L and absorbed heat to the cooling heat exchanger 21. A cooling pump 23 is disposed on the cooling thermal medium recovery pipe L2. Accordingly, the thermal medium is cooled by heat exchange with the refrigerant while passing through the intermediate unit 20, and the cooled thermal medium is supplied to the cooling unit 30L to perform cooling in the cooling unit 30L.

The cooling unit 30L may be used as a cooling device disposed in an indoor space to cool the indoor space by the cool air transferred from the outdoor unit 10 or may be used as a cooling device disposed in a production line to cool a mold or the like. The cooling unit 30L may also be applied to various spaces and devices requiring cooling such as a cool water supply device.

The heating unit 30H may be used as a heating device disposed in an indoor space to heat the indoor space by the hot air transferred from the outdoor unit 10 or may be used as a heating device disposed in a production line to heat a mold or the like. The heating unit 30H may also be applied to various spaces and devices requiring heating such as a hot water supply device.

The heating unit 30H and the intermediate unit 20 are connected to each other through two of the heating thermal medium pipes H1 and H2 for transferring the thermal medium. The heating thermal medium pipes include the heating thermal medium supply pipe H1 for supplying the thermal medium cooled in a heating heat exchanger 22 to the heating unit 30H, and the heating thermal medium recovery pipe H2 for transferring the thermal medium that has passed through the heating unit 30H and released heat to the heating heat exchanger 22. A heating pump 24 is disposed on the heating thermal medium recovery pipe H2. Accordingly, the thermal medium is heated by heat exchange with the refrigerant while passing through the intermediate unit 20, and the heated thermal medium is transferred to the cooling unit 30L to perform heating in the cooling unit 30L.

The intermediate unit 20 transfers cool air to the cooling unit 30L by causing a low temperature refrigerant supplied from the outdoor unit 10 to exchange heat with the thermal medium transferred through the cooling thermal medium pipes, and transfers hot air to the heating unit 30H by causing a hot temperature refrigerant supplied from the outdoor unit 10 to exchange heat with the thermal medium transferred through the heating thermal medium pipes H1 and H2.

The heating unit 30H and the intermediate unit 20 are connected to the heating unit 30H through the heating thermal medium pipes H1 and H2 through which the thermal medium passes. The heating unit 30H and the intermediate unit 20 are connected to each other through two of the heating thermal medium pipes H1 and H2.

The heat pump system 1 includes a refrigerant circuit for circulating the refrigerant between the outdoor unit 10 and the intermediate unit 20, a cooling thermal medium circuit for circulating the thermal medium between the intermediate unit 20 and the cooling unit 30L, and a heating thermal medium circuit for circulating the thermal medium between the intermediate unit 20 and the heating unit 30H.

The refrigerant circuit generates cool air and hot air and transfers the generated cool air and hot air to the intermediate unit 20. The cool air transferred to the intermediate unit 20 is transferred to the cooling unit 30L through the cooling thermal medium circuit, and the hot air transferred to the intermediate unit 20 is transferred to the heating unit 30H through the heating thermal medium circuit.

The heat pump system 1 has four operation modes: a cooling mode, a heating mode, a cooling-centric mode, and a heating-centric mode. The heat pump system 1 selectively performs any one of the four of the operation modes according to the requirement of the thermal load units 30L and 30H.

The cooling mode is an operation mode selected in a case where only the cooling unit 30L of the thermal load units 30L and 30H operates. In the cooling mode, cool air is supplied only to the cooling unit 30L.

The heating mode is an operation mode selected in a case where only the heating unit 30H of the thermal load units 30L and 30H operates. In the heating mode, hot air is supplied only to the heating unit 30H.

The cooling-centric mode is an operation mode selected in a case where the load required by the cooling unit 30L is larger than the load required by the heating unit 30H when the cooling unit 30L and the heating unit 30H of the thermal load units 30L and 30H simultaneously operate.

The heating-centric mode is an operation mode selected in a case where the load required by the heating unit 30H is larger than the load required by the cooling unit 30L when the cooling unit 30L and the heating unit 30H of the thermal load units 30L and 30H simultaneously operate.

In the case of the cooling-centric mode and the heating-centric mode, cool air is supplied to the cooling unit 30L and at the same time hot air is supplied to the heating unit 30H.

Hereinafter, the outdoor unit 10 will be described in more detail with reference to FIG. 1.

The outdoor unit 10 includes a compressor 11 for compressing a refrigerant at a high temperature and a high pressure, a four-way valve 12 disposed on an outlet side of the compressor 11 for switching the flow passage of the refrigerant discharged from the compressor 11, a check valve 13 for allowing the refrigerant to flow only in a forward direction, an on-off valve 14 for switching the flow passage of the refrigerant, and an outdoor heat exchanger 15 for allowing the refrigerant to exchange heat with outdoor air passing through the outdoor unit 10.

The outdoor unit 10 also includes a blowing fan 16 for passing outdoor air through the outdoor heat exchanger 15, an accumulator 17 disposed on a suction side of the compressor 11 for separating liquid refrigerant, and an outdoor expansion valve 18 for decompressing and expanding the refrigerant.

The compressor 11 is a device for compressing a refrigerant at a high temperature and a high pressure, and may be constituted by an inverter compressor capable of controlling the capacity.

The four-way valve 12 is composed of a solenoid valve for switching the flow passage, connected to the compressor 11 through the first refrigerant pipe P1, connected to the outdoor heat exchanger 15 through the second refrigerant pipe P2, connected to the heating heat exchanger 22, which will be described later, through the third refrigerant pipe P3, and connected to the suction side of the compressor 11 through the fourth refrigerant pipe P4. Because the accumulator 17 is connected to the suction side of the compressor 11, the fourth refrigerant pipe P4 is connected to the accumulator 17.

Therefore, the refrigerant discharged from the compressor 11 is transferred to the four-way valve 12 through the first refrigerant pipe P1, and then is guided to one of the outdoor heat exchanger 15 and the heating heat exchanger 22 by the four-way valve 12.

The four-way valve 12 switches the flow passage so that the refrigerant discharged from the compressor 11 is transferred to the heating heat exchanger 22, which will be described later, through the third refrigerant pipe P3 on which the check valve 13 is disposed, or is transferred to the outdoor heat exchanger 16 through the second refrigerant pipe P2.

The flow passage switching through the four-way valve 12 is performed according to the operation mode, that is, the change of the load required by the cooling unit 30L and the heating unit 30H.

The check valve 13 is disposed on the second refrigerant pipe P2 for guiding the refrigerant discharged from the compressor 11 to the heating heat exchanger 22 to prevent the refrigerant from flowing backward.

The second refrigerant pipe P2 and the third refrigerant pipe P3 are connected through the seventh refrigerant pipe P7 branched from a downstream side of the forward direction of the check valve 13 on the third refrigerant pipe P3. The seventh refrigerant pipe P7 is provided with the on-off valve 14 for selectively flowing the refrigerant through the seventh refrigerant pipe P7 according to the operation mode.

The on-off valve 14 includes a two-way solenoid valve that selectively opens and closes an internal flow passage in accordance with the power application.

The outdoor heat exchanger 15 causes the outdoor air supplied by the blowing fan 16 to exchange heat with the refrigerant. The outdoor heat exchanger 15 is connected to the cooling heat exchanger 21 and the heating heat exchanger 22, which will be described later.

The outdoor heat exchanger 15 operates as a condenser for cooling the refrigerant when the cooling mode and the cooling-centric mode, which constitute a cooling operation, are performed. That is, in the case of the cooling operation, the refrigerant passing through the outdoor heat exchanger 15 is condensed by radiating heat.

Also, the outdoor heat exchanger 15 operates as an evaporator for allowing the refrigerant to absorb heat when the heating mode and the heating-centric mode, which constitute a heating operation, are performed. That is, in the case of the heating operation, the refrigerant passing through the outdoor heat exchanger 15 evaporates by absorbing heat.

The sixth refrigerant pipe P6 is connected to the outdoor heat exchanger 15 together with the second refrigerant pipe P2 described above. The sixth refrigerant pipe P6 is branched into two pieces, and one of the two pieces forms a cooling refrigerant pipe P6-1 connected to the cooling heat exchanger 21, and the other forms a heating refrigerant pipe P6-2 connected to the heating heat exchanger 22.

The blowing fan 16 includes an axial flow fan for blowing air in an axial direction. The blowing fan includes a hub portion to which a rotation shaft of a motor is connected, and a plurality of wings extending in a radial direction from the hub portion. As the blowing fan rotates, air flows in the axial direction and passes through the outdoor heat exchanger 15, and the air passing through the outdoor heat exchanger 15 exchanges heat with the refrigerant passing through the inside of the outdoor heat exchanger 15.

The accumulator 17 is connected to the suction side of the compressor 11 through the eighth refrigerant pipe P8. The accumulator 17 stores the surplus refrigerant generated due to the difference in the amount of refrigerant required during the heating operation and the cooling operation, and the surplus refrigerant due to an excessive operation mode change. In addition to the eighth refrigerant pipe P8, the fourth refrigerant pipe P4 and the fifth refrigerant pipe P5 are connected to the accumulator 17, so that the accumulator 17 is connected to the four-way valve 12 through the fourth refrigerant pipe P4 and connected to the cooling heat exchanger 21 through the fifth refrigerant pipe P5. The fifth refrigerant pipe P5 guides the refrigerant that has passed through the cooling heat exchanger 21 to the suction side of the compressor 11.

The outdoor expansion valve 18 includes an electronic expansion valve capable of adjusting the opening degree.

The outdoor expansion valve 18 is disposed in a section before the branch of the sixth refrigerant pipe P6. That is, the outdoor expansion valve 18 is installed at an outlet side of the outdoor heat exchanger 15 when the refrigerant travels from the outdoor heat exchanger 15 to the cooling heat exchanger 21.

The outdoor heat exchanger 15 is connected to a refrigerant outlet side (during heating operation) of the heating heat exchanger 22 and a refrigerant inlet side (during cooling operation) of the cooling heat exchanger 21 through the outdoor expansion valve 18. Also, the outdoor heat exchanger 15 is connected to an inlet side (during heating operation) of the heating heat exchanger 22 through the on-off valve 14.

The outdoor unit 10 includes an outdoor processor C1 for controlling the configurations of the outdoor unit 10 such as the compressor 11, the blowing fan 16, the operation of the outdoor expansion valve 18, and the four-way valve 12. The outdoor processor C1 includes a ROM (Read Only Memory), a RAM (Random Access Memory), and a CPU (Central Processing Unit). Therefore, various programs stored in the ROM of the outdoor processor C1 are read out from the RAM and executed by the CPU, whereby the configurations of the outdoor unit 10 are controlled.

Hereinafter, the intermediate unit 20 will be described in more detail with reference to FIG. 1.

The intermediate unit 20 includes the cooling heat exchanger 21 for transferring cool air to the thermal medium and the heating heat exchanger 22 for transferring hot air to the thermal medium. Herein, the thermal medium may be a liquid such as water or antifreeze.

The cooling heat exchanger 21 transfers cool air to the thermal medium by allowing the low temperature refrigerant transferred from the outdoor unit 10 to exchange heat with the thermal medium. The cooling heat exchanger 21 operates as an evaporator when the cooling mode, the cooling-centric mode, and the heating-centric mode are performed. That is, the cooling heat exchanger 21 cools the thermal medium by absorbing heat from the thermal medium when the cooling mode, the cooling-centric mode, and the heating-centric mode are performed.

The heating heat exchanger 22 transfers hot air to the thermal medium by allowing the high temperature refrigerant transferred from the outdoor unit 10 to exchange heat with the thermal medium. The heating heat exchanger 22 operates as a condenser when the heating mode, the cooling-centric mode, and the heating-centric mode are performed. That is, the heating heat exchanger 22 heats the thermal medium by supplying heat to the thermal medium when the heating mode, the cooling-centric mode, and the heating-centric mode are performed.

The intermediate unit 20 includes the cooling pump 23 for circulating the thermal medium through the cooling thermal medium pipes L1 and L2 and the heating pump 24 for circulating the thermal medium through the heating thermal medium pipes H1 and H2.

The intermediate unit 20 also includes an intermediate expansion valve 25 for decompressing and expanding the refrigerant. The intermediate expansion valve 25 is constituted by an electronic expansion valve as in the outdoor expansion valve 18. The intermediate expansion valve 25 is installed at an inlet side (during cooling operation) of the cooling heat exchanger 21.

The intermediate unit 20 includes an intermediate processor C2 for controlling the configurations of the intermediate unit 20 such as the intermediate expansion valve 25, the cooling pump 23, and the heating pump 24. The intermediate processor C2 includes a ROM (Read Only Memory), a RAM (Random Access Memory), and a CPU (Central Processing Unit). Therefore, various programs stored in the ROM of the intermediate processor C2 are read out from the RAM and executed by the CPU, whereby the configurations of the intermediate processor C2 are controlled.

The outdoor processor C1 and the intermediate processor C2 are configured to be able to communicate with each other to control the operation of the heat pump system 1 while transmitting and receiving signals with each other.

The intermediate unit 20 includes a cooling refrigerant pressure sensor PS1 for detecting the refrigerant pressure at a refrigerant outlet side of the cooling heat exchanger 21, a cooling temperature sensor T1 disposed at a thermal medium outlet side of the cooling heat exchanger 21 and detecting the temperature of the thermal medium cooled through the cooling heat exchanger 21, and a heating temperature sensor T2 disposed at a thermal medium outlet side of the heating heat exchanger 22 and detecting the temperature of the thermal medium heated through the heating heat exchanger 22.

The information detected by the cooling refrigerant pressure sensor PS1 and the information detected by the cooling temperature sensor T1 and the heating temperature sensor T2 are transmitted to the intermediate processor C2 to be used for controlling the operation of the heat pump system 1.

The configurations forming the intermediate unit 20 above are all accommodated in one housing, but this is merely an example, and the present disclosure is not limited thereto. That is, the cooling heat exchanger 21, the cooling pump 23 and the cooling temperature sensor T1 may be accommodated in one housing, and the heating heat exchanger 22, the heating pump 24 and the heating temperature sensor T2 may be accommodated in the other housing.

Hereinafter, a case where the heat pump system according to an aspect of the present disclosure performs the cooling mode will be described with reference to FIG. 2. In FIG. 2, the flow of the refrigerant is indicated by a solid line arrow, and the flow of the thermal medium is indicated by a dotted arrow.

First, the refrigerant flow in the cooling mode will be described.

In the cooling mode, the four-way valve 12 guides the refrigerant to a second flow passage. That is, the four-way valve 12 guides the refrigerant to flow in the direction of an arrow A1. At this time, the on-off valve 14 closes the flow passage, and the outdoor expansion valve 18 completely opens the flow passage.

The opening degree of the intermediate expansion valve 25 is controlled so as to correspond to the outlet superheat degree of the cooling heat exchanger 21. More specifically, when the opening degree of the intermediate expansion valve 25 is increased in the cooling mode, the amount of refrigerant to be decompressed and expanded increases, and the temperature of the refrigerant outlet side of the cooling heat exchanger 21 becomes lower. Conversely, when the opening degree of the intermediate expansion valve 25 decreases, the amount of refrigerant to be decompressed and expanded decreases, and the temperature of the refrigerant outlet side of the cooling heat exchanger 21 increases. Therefore, by controlling the opening degree of the intermediate expansion valve 25, the outlet superheat degree of the cooling heat exchanger 21, that is, the temperature difference between the refrigerant inlet side and the refrigerant outlet side of the cooling heat exchanger 21 may be controlled to a set value.

The refrigerant is compressed by the compressor 11 to become a high-temperature and high-pressure gas state and is transferred to the outdoor heat exchanger 15, which operates as a condenser through the four-way valve 12. The refrigerant is cooled and condensed by heat exchange with outdoor air in the outdoor heat exchanger 15. The condensed refrigerant passes through the outdoor expansion valve 18 and is transferred to the intermediate expansion valve 25, and is decompressed and expanded by the intermediate expansion valve 25. Subsequently, the refrigerant is delivered to the cooling heat exchanger 21, which operates as an evaporator. Because the refrigerant absorbs heat from the thermal medium in the cooling heat exchanger 21, the thermal medium is cooled. The refrigerant having passed through the cooling heat exchanger 21 passes through the accumulator 17, and then is sucked into the compressor 11 again.

As such, in the cooling mode, a refrigerant circuit in which the refrigerant circulates through the compressor 11, the four-way valve 12, the outdoor heat exchanger 15, the outdoor expansion valve 18, the intermediate expansion valve 25, the cooling heat exchanger 21 and the accumulator 17 in order is configured.

Next, the flow of the thermal medium in the cooling mode will be described.

As the cooling pump 23 is driven, the thermal medium flows from the cooling unit 30L to the cooling pump 23, and then is transferred from the cooling pump 23 to the cooling heat exchanger 21. Because the refrigerant absorbs the heat of the thermal medium in the cooling heat exchanger 21, the thermal medium is cooled. Because the cooled thermal medium is transferred to the cooling unit 30L again, cool air is supplied to the cooling unit 30L through the thermal medium.

As such, in the cooling mode, a thermal medium circuit in which the thermal medium circulates through the cooling unit 30L, the cooling pump 23 and the cooling heat exchanger 21 in order is configured.

Hereinafter, a case where the heat pump system according to an aspect of the present disclosure performs the heating mode will be described with reference to FIG. 3. In FIG. 3, the flow of the refrigerant is indicated by a solid line arrow, and the flow of the thermal medium is indicated by a dotted arrow.

First, the refrigerant flow in the heating mode will be described.

In the heating mode, the four-way valve 12 guides the refrigerant to a first flow passage. That is, the four-way valve 12 guides the refrigerant to flow in the direction of an arrow A2. At this time, the on-off valve 14 and the intermediate expansion valve 25 each close the flow passage.

Also, the opening degree of the outdoor expansion valve 18 is controlled to correspond to the outlet superheat degree of the outdoor heat exchanger 15 as in the opening degree of the intermediate expansion valve 25 in the cooling mode described above.

The refrigerant is compressed by the compressor 11 to become a high-temperature and high-pressure gas state and passes through the four-way valve 12 and the check valve 13 in turn, and then is transferred to the heating heat exchanger 22, which operates as a condenser. The refrigerant is cooled and condensed by heat exchange with the thermal medium in the heating heat exchanger 22, and the thermal medium is heated by absorbing heat from the refrigerant.

The refrigerant condensed in the heating heat exchanger 22 is transferred to the outdoor expansion valve 18 and decompressed and expanded by the outdoor expansion valve 18. The refrigerant decompressed and expanded is transferred to the outdoor heat exchanger 15, which operates as an evaporator, and absorbs heat and evaporates by heat exchange with outdoor air in the outdoor heat exchanger 15. Subsequently, the refrigerant passes through the four-way valve 12 and the accumulator 17 and is sucked into the compressor 11 again.

As such, in the heating mode, a refrigerant circuit in which the refrigerant circulates through the compressor 11, the four-way valve 12, the check valve 13, the heating heat exchanger 22, the outdoor expansion valve 18, the outdoor heat exchanger 15, the four-way valve 12 and the accumulator 17 in order is configured.

Next, the flow of the thermal medium in the heating mode will be described.

As the heating pump 24 is driven, the thermal medium flows from the heating unit 30H to the heating pump 24, and then is transferred from the heating pump 24 to the heating heat exchanger 22. Because the thermal medium absorbs the heat of the refrigerant in the heating heat exchanger 22, the thermal medium is heated. Because the heated thermal medium is transferred to the heating unit 30H again, hot air is supplied to the heating unit 30H through the thermal medium.

As such, in a heating mode, the thermal medium circuit in which the thermal medium circulates through the heating unit 30H, the heating pump 24 and the heating heat exchanger 22 in order is configured.

Hereinafter, a case where the heat pump system according to an aspect of the present disclosure performs the cooling-centric mode will be described with reference to FIG. 4. In FIG. 4, the flow of the refrigerant is indicated by a solid line arrow, and the flow of the thermal medium is indicated by a dotted arrow.

First, the refrigerant flow in the cooling-centric mode will be described.

In the cooling-centric mode, the four-way valve 12 guides the refrigerant to the second flow passage. That is, the four-way valve 12 guides the refrigerant to flow in the direction of the arrow A1. At this time, the opening degree of the intermediate expansion valve 25 is controlled to correspond to the outlet superheat degree of the cooling heat exchanger 21 as in the cooling mode described above.

The opening degree of the outdoor expansion valve 18 is controlled to correspond to the load required by the heating unit 30H. More specifically, when the opening degree of the outdoor expansion valve 18 decreases, the amount of refrigerant transferred to the heating heat exchanger 22 through the on-off valve 14 increases. Therefore, the outdoor expansion valve 18 is controlled such that the opening degree of the outdoor expansion valve 18 becomes smaller as the load required by the heating unit 30H becomes larger.

The refrigerant is compressed by the compressor 11 to become a high-temperature and high-pressure gas state and is guided to the outdoor heat exchanger 15 and the on-off valve 14 by the four-way valve 12.

A part of the refrigerant discharged from the compressor is transferred to the outdoor heat exchanger 15, which operates as a condenser, and the refrigerant transferred to the outdoor heat exchanger 15 is cooled and condensed by heat exchange with outdoor air in the outdoor heat exchanger 15. The condensed refrigerant passes through the outdoor expansion valve 18 and is transferred to the intermediate expansion valve 25.

On the other hand, the remaining refrigerant is transferred to the on-off valve 14, and the refrigerant transferred to the on-off valve 14 passes through the on-off valve 14 and is transferred to the heating heat exchanger 22, which operates as a condenser. The refrigerant is condensed while heating the thermal medium in the heating heat exchanger 22. Herein, the thermal medium is heated by absorbing heat from the refrigerant. The refrigerant condensed while passing through the heating heat exchanger 22 is combined with the refrigerant that has passed through the outdoor heat exchanger 15 and the outdoor expansion valve 18.

The combined refrigerant is decompressed and expanded by the intermediate expansion valve 25 to become a gas-liquid mixture state of low temperature and low pressure. Subsequently, the refrigerant is transferred to the cooling heat exchanger 21, which operates as an evaporator. The refrigerant absorbs heat from the thermal medium in the cooling heat exchanger 21 to become a low-temperature and low-pressure gas state. The refrigerant that has passed through the cooling heat exchanger 21 passes through the accumulator 17 and is sucked into the compressor 11 again.

As such, in the cooling-centric mode, after the refrigerant passes through the compressor 11 and the four-way valve 12, a part of the refrigerant passes through the outdoor heat exchanger 15 and the outdoor expansion valve 18, and the remaining refrigerant passes through the on-off valve 14 and the heating heat exchanger 22, and then is combined again. The combined refrigerant sequentially passes through the intermediate expansion valve 25, the cooling heat exchanger 21 and the accumulator 17, and then is sucked into the compressor again, thereby constituting the refrigerant circuit.

The flow of the thermal medium in the cooling-centric mode is the same as that in the cooling mode and the heating mode. That is, the thermal medium circuit for supplying cool air to the cooling unit 30L is configured by causing the thermal medium to sequentially circulate through the cooling unit 30L, the cooling pump 23 and the cooling heat exchanger 21, and the thermal medium circuit for supplying hot air to the heating unit 30H is configured by causing the thermal medium to sequentially circulate through the heating unit 30H, the heating pump 24 and the heating heat exchanger 22.

Hereinafter, a case where the heat pump system according to an aspect of the present disclosure performs the heating-centric mode will be described with reference to FIG. 5. In FIG. 5, the flow of the refrigerant is indicated by a solid line arrow, and the flow of the thermal medium is indicated by a dotted arrow.

First, the refrigerant flow in the heating-centric mode will be described.

In the heating-centric mode, the four-way valve 12 guides the refrigerant to the first flow passage. That is, the four-way valve 12 guides the refrigerant to flow in the direction of the arrow A2. The on-off valve 14 closes the flow passage, and the opening degree of the intermediate expansion valve 25 is controlled to correspond to the outlet superheat degree of the cooling heat exchanger 21 as in the above-described cooling mode. The opening degree of the outdoor expansion valve 18 is controlled to correspond to the load required by the cooling unit 30L. More specifically, when the opening degree of the outdoor expansion valve 18 decreases, the amount of refrigerant transferred to the cooling heat exchanger 21 increases. Therefore, the outdoor expansion valve 18 is controlled such that the opening degree of the outdoor expansion valve 18 becomes smaller as the load required by the cooling unit 30L becomes larger.

The refrigerant is compressed by the compressor 11 to become a high-temperature and high-pressure gas state and passes through the four-way valve 12 and the check valve 13 in turn, and then is transferred to the heating heat exchanger 22, which operates as a condenser. The refrigerant is cooled and condensed by heating the thermal medium in the heating heat exchanger 22.

A part of the refrigerant condensed in the heating heat exchanger 22 is transferred to the intermediate expansion valve 25 and the remaining refrigerant is transferred to the outdoor expansion valve 18.

The refrigerant transferred to the intermediate expansion valve 25 is decompressed and expanded by the intermediate expansion valve 25 to become a gas-liquid mixed refrigerant of low temperature and low pressure, and then is transferred to the cooling heat exchanger 21, which operates as an evaporator. The refrigerant absorbs heat from the thermal medium in the cooling heat exchanger 21 to become a high-temperature and high-pressure gas state. At this time, because the refrigerant absorbs heat from the thermal medium, the thermal medium is cooled. The refrigerant having passed through the cooling heat exchanger 21 passes through the accumulator 17, and then is sucked into the compressor 11 again.

On the other hand, the refrigerant transferred to the outdoor expansion valve 18 is decompressed and expanded by the outdoor expansion valve 18 to become a gas-liquid mixture state of low temperature and low pressure. Subsequently, the refrigerant is transferred to the outdoor heat exchanger 15, which operates as an evaporator. The refrigerant absorbs heat by heat exchange with outdoor air in the outdoor heat exchanger 15 to become a low-temperature and low-pressure gas state, and passes through the four-way valve 12 and the accumulator 17, and then is sucked into the compressor 11 again.

As such, in the heating-centric mode, after the refrigerant passes through the compressor 11, the four-way valve 12, the check valve 13 and the heating heat exchanger 22, a part of the refrigerant passes through the intermediate expansion valve 25 and the cooling heat exchanger 21 in turn, and the remaining refrigerant passes through the outdoor expansion valve 18, the outdoor heat exchanger 15 and the four-way valve 12 in turn and then is combined again. The combined refrigerant passes through the accumulator 17, and then is sucked into the compressor 11 again, thereby constituting the refrigerant circuit.

The flow of the thermal medium in the heating-centric mode is the same as that in the cooling mode and the heating mode. That is, the thermal medium circuit for supplying cool air to the cooling unit 30L is configured by causing the thermal medium to sequentially circulate through the cooling unit 30L, the cooling pump 23 and the cooling heat exchanger 21, and the thermal medium circuit for supplying hot air to the heating unit 30H is configured by causing the thermal medium to sequentially circulate through the heating unit 30H, the heating pump 24 and the heating heat exchanger 22.

Hereinafter, low-pressure pressure maintenance control of the heat pump system 1 according to the present embodiment will be described with reference to FIG. 6. The low-pressure pressure maintenance control is performed in a cooling mode, a cooling-centric mode, and a heating-centric mode.

FIG. 6 illustrates the heat pump system 1 in which a refrigerant flow rate regulating valve 26 is added to the intermediate unit 20 shown in FIG. 1.

The refrigerant flow rate regulating valve 26 is disposed on the fifth refrigerant pipe P5 between the cooling heat exchanger 21 and the accumulator 17, that is, on the refrigerant outlet side of the cooling heat exchanger 21.

The low-pressure pressure maintenance control is performed by controlling the opening degree of the refrigerant flow rate regulating valve 26 so that the pressure at the refrigerant outlet side of the cooling heat exchanger 21 becomes a value within a set range. That is, the low-pressure pressure maintenance control controls the opening degree of the refrigerant flow rate regulating valve 26 so that the evaporation pressure of the refrigerant in the cooling heat exchanger 21 becomes a value within a set range. As a further explanation, the opening degree of the refrigerant flow rate regulating valve 26 is controlled such that the evaporation temperature calculated from the refrigerant pressure at the outlet side of the cooling heat exchanger 21 does not reach the freezing temperature of the heating medium or lower.

More specifically, the pressure at the refrigerant outlet side of the cooling heat exchanger 21 is detected by the cooling refrigerant pressure sensor PS1. When the detected pressure of the refrigerant is lower than the set range, the refrigerant flow rate regulating valve 26 is controlled to decrease the opening degree of the refrigerant flow rate regulating valve 26. When the opening degree of the refrigerant flow rate regulating valve 26 decreases, the pressure at the refrigerant outlet side of the cooling heat exchanger 21 increases. When the detected pressure of the refrigerant exceeds the set range, the refrigerant flow rate regulating valve 26 is controlled to increase the opening degree of the refrigerant flow rate regulating valve 26. As the opening degree of the refrigerant flow rate regulating valve 26 increases, the pressure at the refrigerant outlet side of the cooling heat exchanger 21 decreases. As described above, the opening of the refrigerant flow rate regulating valve 26 is controlled such that the refrigerant pressure at the outlet side of the cooling heat exchanger 21 is maintained within the set range.

As a further explanation, when the heat pump system 1 is operated in the heating-centric mode in the winter season in which the ambient temperature of the outdoor heat exchanger 15 is low, the evaporation pressure of the outdoor heat exchanger 15 may be lowered and at the same time the evaporation pressure of the cooling heat exchanger 21 may be lowered. Herein, when the evaporation pressure of the cooling heat exchanger 21 becomes abnormally low, the flow rate of the refrigerant passing through the cooling heat exchanger 21 increases, so that the thermal medium may be cooled to an appropriate level or higher, and as a result, the thermal medium passing through the cooling thermal medium pipes L1 and L2 may be frozen.

Accordingly, when the pressure of the refrigerant detected by the cooling refrigerant pressure sensor PS1 becomes abnormally low and deviates from the set range, the low-pressure pressure maintenance control controls the refrigerant flow rate regulating valve 26 so that the opening degree of the refrigerant flow rate regulating valve 26 decreases. Because the pressure of the refrigerant passing through the cooling heat exchanger 21 increases as the opening degree of the refrigerant flow regulating valve 26 decreases, freezing of the thermal medium in the cooling thermal medium pipes L1 and L2 may be suppressed. In addition, cool air may be stably supplied to the cooling unit 30L.

Next, cool water temperature decrease prevention control of the heat pump system 1 according to the present embodiment will be described with reference to FIG. 7. The cool water temperature decrease prevention control is performed in the cooling mode, the cooling-centric mode, and the heating-centric mode.

FIG. 7 illustrates the heat pump system 1 in which a refrigerant bypass pipe B1 and a bypass expansion valve 27 are added to the intermediate unit 20 shown in FIG. 1.

The refrigerant bypass pipe B1 is branched from the cooling refrigerant pipe P6-1 extending from the outdoor expansion valve 18 to the intermediate expansion valve 25 and is connected to the fifth refrigerant pipe P5 connecting the cooling heat exchanger 21 and the accumulator 17, so that the refrigerant may bypass the cooling heat exchanger 21 to be transferred to the compressor 11.

The bypass expansion valve 27 is provided as a solenoid valve capable of adjusting the opening degree and disposed on the refrigerant bypass pipe B1 to open and close a flow passage of the refrigerant bypass pipe B1. In a normal state, the bypass expansion valve 27 closes the flow passage of the refrigerant bypass pipe B1 to block the flow of the refrigerant through the refrigerant bypass pipe B1.

When the temperature of the thermal medium detected by the cooling temperature sensor T1 is lower than a set threshold value, the cool water temperature decrease prevention control controls the intermediate expansion valve 25 to close the flow passage of the cooling refrigerant pipe P6-1, which is the inlet side of the cooling heat exchanger, and at the same time controls the bypass expansion valve 27 to open the flow passage of the refrigerant bypass pipe B1.

When the flow passage of the refrigerant pipe on the inlet side of the cooling heat exchanger 21 is closed through the intermediate expansion valve 25, the refrigerant transfer to the cooling heat exchanger 21 is blocked. Further, as the flow passage of the refrigerant bypass pipe B1 is opened through the bypass expansion valve 27, the refrigerant is transferred to the bypass expansion valve 27, as indicated by an arrow in the figure. Thereafter, in a case where the temperature of the thermal medium detected by the cooling temperature sensor T1 becomes equal to or higher than the set threshold value, when the intermediate expansion valve 25 is controlled to open the inlet side of the cooling heat exchanger 21, that is, the flow passage of the cooling refrigerant pipe P6-1 and the bypass expansion valve 27 is controlled to close the flow passage of the refrigerant bypass pipe B1, the refrigerant is again transferred to the cooling heat exchanger 21.

As a further explanation, when the temperature of the thermal medium is very low, the thermal medium may be frozen. Therefore, when the temperature of the thermal medium is lower than the set threshold value, the cool water temperature decrease prevention control closes the intermediate expansion valve 25 to block the inflow of the refrigerant into the cooling heat exchanger 21. Because the thermal medium is not cooled when the inflow of the refrigerant into the cooling heat exchanger 21 is blocked, the thermal medium passing through the cooling thermal medium pipes L1 and L2 is prevented from freezing. Herein, it is preferable that the set threshold value is set to a temperature slightly higher than the freezing temperature of the thermal medium. For example, when the thermal medium is water, it is preferable that the set threshold value is set to 2° C. or the like, which is slightly higher than 0° C., which is the freezing temperature.

Further, the refrigerant bypass pipe B1 and the bypass expansion valve 27 are provided so that the refrigerant may be circulated even when the flow passage of the cooling refrigerant pipe P6-2 is closed by the intermediate expansion valve 25. Accordingly, the refrigerant transferred from the outdoor expansion valve 18 is transferred to the compressor 11 side through the refrigerant bypass pipe B1 by closing the intermediate expansion valve 25 and opening the bypass expansion valve 27.

Next, defrost control of the heat pump system 1 according to the present embodiment will be described with reference to FIG. 8. The defrost control includes a first defrost mode, a second defrost mode and a third defrost mode.

FIG. 8 illustrates the heat pump system 1 in which a defrost bypass pipe B2 and a refrigerant passage switching valve 28 are added to the intermediate unit 20 shown in FIG. 7.

One end of the defrost bypass pipe B2 is connected to the third refrigerant pipe P3 connecting the four-way valve 12 and the heating heat exchanger 22, and the other end of the defrost bypass pipe B2 is connected to the fifth refrigerant pipe P5 connecting the cooling heat exchanger 21 and the accumulator 17. That is, the defrost bypass pipe B2 connects the refrigerant inlet side flow passage of the heating heat exchanger 22 and the refrigerant outlet side flow passage of the cooling heat exchanger 21.

The refrigerant passage switching valve 28 is disposed on the defrost bypass pipe B2 such that the flow of the refrigerant through the defrost bypass pipe B2 is selectively performed. In a normal state, the refrigerant passage switching valve 28 keeps the flow passage closed to block the flow of the refrigerant through the defrost bypass pipe B2.

First, the first defrost mode will be described.

When defrosting is required by the outdoor heat exchanger 15 while the heating mode is being performed, the heating mode is switched to the first defrost mode. Herein, the defrost request of the outdoor heat exchanger 15 is confirmed by the temperature and the pressure of the refrigerant transferred to the outdoor heat exchanger 15 or the refrigerant discharged from the outdoor heat exchanger 15, or the outdoor temperature and the like. The case where the defrost request of the outdoor heat exchanger 15 has occurred means that the setting condition for performing the defrosting of the outdoor heat exchanger 15 is satisfied. As a more specific example, this may be the case where the refrigerant temperature at the outlet side of the outdoor heat exchanger 15 is lower than a set temperature in a state in which the heating mode is being performed.

As a further explanation, when it is confirmed that in the state where the heating mode is being performed, the temperature of the refrigerant at the outlet side of the outdoor heat exchanger 15 is lower than the set threshold value and the temperature of the thermal medium detected by the heating temperature sensor T2 is higher than the set threshold value, the heating mode is switched to the first defrost mode.

On the other hand, when it is confirmed that in the state where the heating mode is being performed, the temperature of the refrigerant at the outlet side of the outdoor heat exchanger 15 is lower than the set threshold value and the temperature of the thermal medium detected by the heating temperature sensor T2 is also lower than the set threshold value, the heating mode is switched to the second defrost mode, which will be described later.

FIG. 9 is a view illustrating flows of the refrigerant and the thermal medium in the first defrost mode. In FIG. 9, the flow of the refrigerant is indicated by a solid line arrow, and the flow of the thermal medium is indicated by a dotted arrow.

In the first defrost mode, the four-way valve 12 guides the refrigerant to the outdoor heat exchanger 15. That is, the four-way valve 12 guides the refrigerant to flow in the direction of the arrow A1. Further, the on-off valve 14, the intermediate expansion valve 25, and the bypass expansion valve 27 all close the flow passages, and the refrigerant passage switching valve 28 opens the flow passage. On the other hand, the opening degree of the outdoor expansion valve 18 is controlled to correspond to the outlet superheat degree of the heating heat exchanger 22, like the opening degree of the intermediate expansion valve 25 in the cooling mode described above.

The refrigerant is compressed by the compressor 11 to become a high-temperature and high-pressure gas state and is transferred to the outdoor heat exchanger 15 through the four-way valve 12. Because the refrigerant radiates heat in the outdoor heat exchanger 15, the frost generated on the surface of the outdoor heat exchanger 15 is removed. The refrigerant having passed through the outdoor heat exchanger 15 is decompressed and expanded by the outdoor expansion valve 18 to become a gas-liquid mixture state of low temperature and low pressure and is transferred to the heating heat exchanger 22, which operates as an evaporator. The refrigerant is heated by absorbing heat from the thermal medium in the heating heat exchanger 22. The refrigerant having passed through the heating heat exchanger 22 passes through the refrigerant passage switching valve 28 and the accumulator 17 in turn and is sucked into the compressor 11 again.

As such, in the first defrost mode, a refrigerant circuit in which the refrigerant circulates through the compressor 11, the four-way valve 12, the outdoor heat exchanger 15, the outdoor expansion valve 18, the heating heat exchanger 22, the refrigerant passage switching valve 28 and the accumulator 17 in order is configured. The refrigerant is heated by the heat absorbed from the thermal medium, and the heated refrigerant is transferred to the outdoor heat exchanger 15 to perform defrosting of the outdoor heat exchanger 15.

In the first defrost mode, a thermal medium circuit in which the thermal medium circulates through the heating unit 30H, the heating pump 24 and the heating heat exchanger 22 in order is configured. Because the thermal medium circulates along the heating thermal medium pipes H1 and H2 in the first defrost mode, hot air is continuously supplied to the heating unit 30H.

However, because the thermal medium that has been cooled by heat exchange with the refrigerant in the heating heat exchanger 22 is transferred to the heating unit 30H, the hot air to be supplied may be reduced compared to when the heating mode is performed.

Further, when the lengths of the heating thermal medium pipes H1 and H2 are short, the heat capacity of the thermal medium may not be sufficiently secured. As such, when the thermal capacity of the thermal medium may not be sufficiently secured, the amount of heat required for defrosting exceeds the heat capacity of the thermal medium, so that hot air may not be supplied to the heating unit 30H and heat may be absorbed from the heating unit 30H to cause the heating unit 30H to perform cooling.

Therefore, before the cooling is performed by absorbing heat from the heating unit 30H, it is necessary to stop the absorption of heat from the thermal medium to prevent the cooling in the heating unit 30H from being performed.

More specifically, when the temperature of the thermal medium circulating along the heating thermal medium pipes H1 and H2 is lower than the set threshold value in the state where the first defrost mode is being performed, the first defrost mode is switched to the second defrost mode. Also, as described above, in the state where the heating mode is being performed, when the temperature of the refrigerant at the outlet side of the outdoor heat exchanger 15 is lower than the set threshold value and the temperature of the thermal medium circulating along the heating thermal medium pipes H1 and H2 is lower than the set threshold value, the heating mode is switched to the second defrost mode.

The set threshold value for the thermal medium temperature in the case where the first defrost mode or the heating mode is switched to the second defrost mode may be determined by the air temperature of the room in which the heating unit 30H is disposed. That is, when the temperature of the thermal medium circulating along the heating thermal medium pipes H1 and H2 is lower than the set indoor air temperature of the heating unit 30H in the state where the first defrost mode is being performed, the first defrost mode is switched to the second defrost mode.

FIG. 10 is a view illustrating flows of the refrigerant and the thermal medium in the second defrost mode. In FIG. 10, the flow of the refrigerant is indicated by a solid line arrow.

In the second defrost mode, the four-way valve 12 guides the refrigerant to the outdoor heat exchanger 15. That is, the four-way valve 12 guides the refrigerant to flow in the direction of the arrow A1. In addition, the on-off valve 14, the refrigerant passage switching valve 28 and the outdoor expansion valve 18 open the flow passages, and the intermediate expansion valve 25 closes the flow passage.

The refrigerant is compressed by the compressor 11 to become a high-temperature and high-pressure gas state and is transferred to the outdoor heat exchanger 15 through the four-way valve 12. Because the refrigerant radiates heat in the outdoor heat exchanger 15, the frost adhering to the surface of the outdoor heat exchanger 15 is removed. The refrigerant passing through the outdoor heat exchanger 15 passes through the outdoor expansion valve 18, but is not transferred to the heating heat exchanger 22 and decompressed and expanded by the bypass expansion valve 27 to become a gas-liquid mixed state of low temperature and low pressure. The refrigerant expanded by the bypass expansion valve 27 is mixed with the high temperature and high pressure refrigerant transferred through the defrost bypass pipe B2 to become superheated gas, and then sucked into the compressor 11 through the accumulator 17.

Accordingly, in the second defrost mode, a refrigerant circuit in which the refrigerant passes and circulates through the compressor 11, the four-way valve 12, the outdoor heat exchanger 15, the outdoor expansion valve 18, the bypass expansion valve 27 and the accumulator 17 in order is configured.

Next, the third defrost mode will be described.

The third defrost mode is a mode in which the defrosting of the outdoor heat exchanger 15 is performed by switching from the heating-centric mode to the cooling-centric mode. That is, when defrosting is required by the outdoor heat exchanger 15 in the state of operating in the heating-centric mode (for example, when the refrigerant temperature at the outlet side of the outdoor heat exchanger 15 is lower than the set threshold value), the heating-centric mode is switched to the cooling-centric mode.

In the heating-centric mode, the refrigerant cooled in the heating heat exchanger 22 is transferred to the outdoor heat exchanger 15, which operates as an evaporator through the outdoor expansion valve 18. As a result, the temperature of the outdoor heat exchanger 15 is lowered, and frost may be generated on the surface of the outdoor heat exchanger 15.

On the other hand, in the cooling-centric mode, a high-temperature and high-pressure gaseous refrigerant compressed by the compressor 11 is transferred to the outdoor heat exchanger 15, which operates as a condenser through the four-way valve 12. Accordingly, the heat pump system 1 switches the heating-centric mode to the cooling-centric mode, so that the refrigerant radiates heat in the outdoor heat exchanger 15 and the frost generated on the surface of the outdoor heat exchanger 15 is removed.

As a further explanation, in the third defrost mode, as the heating-centric mode is switched to the cooling-centric mode, the hot air supplied to the heating load may be reduced, but as the cooling-centric mode is performed, the supply of hot air to the heating unit 30H and the supply of cool air to the cooling unit are continuously performed.

Next, freeze prevention control of the heat pump system 1 according to the present embodiment will be described with reference to FIG. 11.

When the compressor 11, the cooling pump 23, the heating pump 24, etc. are stopped and the refrigerant and the thermal medium are not circulated, the thermal medium may be frozen due to the decrease of the outdoor temperature. When the thermal medium is frozen, the heating heat exchanger 22, the cooling heat exchanger 21, the heating thermal medium pipes H1 and H2, the cooling thermal medium pipes L1 and L2, or the like may be damaged. Therefore, the freeze prevention control is performed to prevent freezing of the thermal medium.

FIG. 11 illustrates the heat pump system 1 in which thermal medium bypass pipes B3 and B4 and thermal medium bypass valves 29L and 29H are added for preventing freezing of the intermediate unit 20 shown in FIG. 1.

The thermal medium bypass pipes B3 and B4 include the cooling thermal medium bypass pipe B3 having one end connected to the cooling thermal medium supply pipe L1 and the other end connected to the cooling thermal medium recovery pipe L2, and the heating thermal medium bypass pipe B4 having one end connected to the heating thermal medium supply pipe H1 and the other end connected to the heating thermal medium recovery pipe H2.

The thermal medium bypass valves 29L and 29H include the cooling thermal medium bypass valve 29L disposed on the cooling thermal medium bypass pipes B3 and B4 to open and close the flow passage of the cooling thermal medium bypass pipes B3 and B4, and the heating thermal medium bypass valve 29H disposed on the heating thermal medium bypass pipes B3 and B4 to open and close the flow passage of the heating thermal medium bypass pipes B3 and B4.

In a normal state, the thermal medium bypass valves 29L and 29H close the flow passages to block the flow of thermal medium through the thermal medium bypass pipes 29L and 29H.

When the freeze prevention control is performed, in a case where the temperature of the thermal medium detected by the heating temperature sensor T2 in a state in which the compressor 11 and the heating pump 24 are stopped and the refrigerant and the thermal medium does not circulate is lower than the set threshold value, the flow passage of the heating thermal medium bypass valve 29H is opened and the heating pump 24 is operated. When the flow passage of the heating thermal medium bypass valve 41 is opened and the heating pump 24 is operated, the thermal medium passes and circulates through the heating pump 24, the heating heat exchanger 22 and the bypass valve 41 in order through the heating thermal medium pipes H1 and H2, as indicated by a dotted arrow in the figure. By circulating the thermal medium in this manner, the temperature of the thermal medium passing through the heating thermal medium pipes H1 and H2 becomes uniform. Further, because the temperature of a part of the thermal medium whose temperature is lowered is raised by the heat transferred from the heating pump 24, freezing of the thermal medium is suppressed.

Herein, it is preferable that the set threshold value is set to a temperature slightly higher than the freezing temperature of the thermal medium. That is, when the thermal medium is water, it is preferable that the set threshold value is set to 3° C. or the like, which is slightly higher than 0° C., which is the freezing temperature.

Further, when the temperature of the thermal medium detected by the heating temperature sensor T2 is equal to or higher than the set threshold value after the thermal medium starts to circulate, the operation of the heating pump 24 may be stopped. Or when the temperature of the thermal medium detected by the heating temperature sensor T2 is equal to or higher than the set threshold after a lapse of a set time such as 5 minutes after the thermal medium starts to circulate, the operation of the heating pump 24 may be stopped.

The freeze prevention control is also performed on the thermal medium passing through the cooling thermal medium pipes L1 and L2. In a case where the temperature of the thermal medium detected by the cooling temperature sensor T1 in a state in which the compressor 11 and the cooling pump 23 are stopped and the refrigerant and the thermal medium does not circulate is lower than the set threshold value, the flow passage of a cooling bypass valve 42 is opened and the cooling pump 23 is operated. As the flow passage of the cooling bypass valve 42 is opened and the cooling pump 23 is operated, the thermal medium passes and circulates through the cooling pump 23, the cooling heat exchanger 21 and the cooling bypass valve 42 in order along the cooling thermal medium pipes L1 and L2, as indicated by the dotted arrow in the figure. By circulating the thermal medium in this manner, the freezing of the thermal medium passing through the cooling thermal medium pipes L1 and L2 is suppressed. Herein, it is preferable that the set threshold value is set to a temperature slightly higher than the freezing temperature of the thermal medium, as in the case of the heating thermal medium pipes H1 and H2.

Further, when the temperature of the thermal medium detected by the cooling temperature sensor T1 is equal to or higher than the set threshold value after the thermal medium starts to circulate, the cooling pump 23 may be stopped again. Or when the temperature of the thermal medium detected by the cooling temperature sensor T1 is equal to or higher than the set threshold after a lapse of a set time such as 5 minutes after the thermal medium starts to circulate, the cooling pump 23 may be stopped again.

Next, water bypass defrost control of the heat pump system 1 according to the present embodiment will be described. The water bypass defrost control is performed in the heating mode and the heating-centric mode. In the water bypass defrost control, defrosting of the outdoor heat exchanger 15 is performed by circulating the thermal medium by bypass-connecting the heating thermal medium pipes H1 and H2 and the cooling thermal medium pipes L1 and L2.

FIG. 12 is a view illustrating a case where the heat pump system 1 performs the water bypass defrost control. FIG. 12 illustrates the heat pump system 1 in which connection bypass pipes B5 and B6 and connection bypass valves 29L1 and 29H1 are added to the intermediate unit 20 shown in FIG. 1.

The connection bypass pipes B5 and B6 include the first connection bypass pipe B5 having one end connected to the heating thermal medium supply pipe H1 and the other end connected to the cooling thermal medium recovery pipe L2, and the second connection bypass pipe B6 having one end connected to the cooling thermal medium supply pipe L1 and the other end connected to the heating thermal medium recovery pipe H2.

The connection bypass pipes B5 and B6 are provided with the first connection bypass valve 29L1 disposed on the first connection bypass pipe B5 to open and close the flow passage of the first connection bypass pipe B5, and the second connection bypass valve 29L1 and 29H1 disposed on the second connection bypass pipe B6 to open and close the flow passage of the second connection bypass pipe B6.

The intermediate unit 20 includes a cooling thermal medium supply valve 29*a* disposed on the cooling thermal medium supply pipe L1 to regulate the amount of thermal medium supplied to the cooling unit 30L, and a cooling thermal medium recovery valve 29*b* disposed on the cooling thermal medium recovery pipe L2 to regulate the amount of thermal medium recovered from the cooling unit 30L. The intermediate unit 20 further includes a heating thermal medium supply valve 29*c* disposed on the heating thermal medium supply pipe H1 to regulate the amount of thermal medium supplied to the heating unit 30H, and a heating thermal medium recovery valve 29*d* disposed on the heating thermal medium recovery pipe H2 to regulate the amount of thermal medium recovered from the heating unit 30H.

In a normal state, the flow passages of the first connection bypass valve 43 and the second connection bypass valve 46 are all kept closed, and the flow passages of the cooling thermal medium supply valve 29*a*, the cooling thermal medium recovery valve 46, the heating thermal medium supply valve 29*d*, and the heating thermal medium recovery valve 29*c* are all kept open.

In the water bypass defrost control, when the defrost request of the outdoor heat exchanger 15 is generated in the state in which the heating mode or the heating-centric mode is being performed (for example, when the refrigerant temperature at the outlet side of the outdoor heat exchanger 15 is lower than the set threshold value), the heating mode or the heating-centric mode is switched to the cooling-centric mode. That is, the outdoor heat exchanger 15 and the heating heat exchanger 22 are operated as a condenser and the cooling heat exchanger 21 is operated as an evaporator. Further, the flow passages of the first connection bypass valve 43 and the second connection bypass valve 46 are opened, and the flow passages of the cooling thermal medium supply valve 29*a*, the cooling thermal medium recovery valve 46, the heating thermal medium supply valve 29*d*, and the heating thermal medium recovery valve 29*c* are all closed.

When the cooling pump 23 and the heating pump 24 are operated in this state, the thermal medium transferred from the cooling heat exchanger 21 passes through the second connection bypass valve 46 and the heating pump 24 and is transferred to the heating heat exchanger 22, as indicated by a dotted arrow in the figure. The thermal medium transferred to the heating heat exchanger 22 is heated by the refrigerant passing through the heating heat exchanger 22, thereby raising the temperature. The thermal medium having the increased temperature passes through the first connection bypass valve 43 and the cooling pump 23 and is transferred to the cooling heat exchanger 21, and is cooled by the refrigerant in the cooling heat exchanger 21 to lower the temperature.

By circulating the thermal medium in this manner, the temperature of the thermal medium circulating through the cooling thermal medium pipes L1 and L2 and the heating thermal medium pipes H1 and H2 is regulated to be maintained within the set range. Also, by circulating the thermal medium, the amount of heat supplied from the refrigerant to the thermal medium in the heating heat exchanger 22 and the amount of heat supplied from the thermal medium to the refrigerant in the cooling heat exchanger 21 are controlled to be kept equal. When a thermal equilibrium state is reached in this manner, the amount of heat that is compressed by the compressor 11 and applied to the refrigerant in accordance with the principle of the heat pump cycle is all supplied to the outdoor heat exchanger 15. In addition, the frost generated on the surface of the outdoor heat exchanger 15 is removed. Further, because the heat capacity of the thermal medium is not limited when defrosting the outdoor heat exchanger 15, the defrosting is stably performed even in the case where the piping amount of the cooling thermal medium pipes L1 and L2 or the heating thermal medium pipes H1 and H2 is small.

Also, by circulating the thermal medium in this manner, defrosting of the outdoor heat exchanger 15 may be performed irrespective of the amount of thermal medium. Further, because the temperature change of the thermal medium is suppressed, the temperature change of the heating unit 30H and the cooling unit 30L is also suppressed.

Next, supercooling degree control of the heat pump system 1 according to the present embodiment will be described. The supercooling degree control is performed in the heating mode.

FIG. 13 is a view illustrating a configuration example of the heat pump system 1 in the case of performing the supercooling degree control. FIG. 13 illustrates the heat pump system 1 in which a heating refrigerant temperature sensor T3, a heating refrigerant pressure sensor PS2, and the refrigerant flow rate regulating valve 26 are added to the intermediate unit 20 shown in FIG. 1.

The heating refrigerant temperature sensor T3 and the heating refrigerant pressure sensor PS2 are provided on the refrigerant outlet side of the heating heat exchanger 22, that is, the heating refrigerant pipe P6-2. The refrigerant flow rate regulating valve 26 is installed on the fifth refrigerant pipe P5 between the cooling heat exchanger 21 and the accumulator 17 as in FIG. 6.

In the supercooling degree control, the opening degree of the intermediate expansion valve 25 and the refrigerant flow rate regulating valve 26 is controlled such that the supercooling degree of the refrigerant at the outlet side of the heating heat exchanger 22 is maintained within a set range. That is, in the supercooling degree control, the opening degree of the intermediate expansion valve 25 and the refrigerant flow rate regulating valve 26 is controlled such that the supercooling degree becomes a value of a set target supercooling degree.

More specifically, the temperature of the refrigerant is detected by the heating refrigerant temperature sensor T3 disposed on the heating refrigerant pipe P6-2, and the pressure of the refrigerant is detected by the heating refrigerant pressure sensor PS2 disposed on the heating refrigerant pipe P6-2. The detected pressure of the refrigerant is converted to the saturation temperature corresponding to the condensation temperature of the refrigerant. The supercooling degree is calculated through the difference between the saturation temperature of the refrigerant and the temperature of the refrigerant detected by the heating refrigerant temperature sensor T3. The opening degree of the intermediate expansion valve 25 and the refrigerant flow rate regulating valve 26 is controlled such that the calculated supercooling degree becomes a value within the set range.

As a further explanation, when the supercooling degree becomes higher than the set range, the intermediate expansion valve 25 is controlled to be opened so as to close the flow passage of the refrigerant flow rate regulating valve 26. That is, when the supercooling degree is higher than the set range, the opening degree of the intermediate expansion valve 25 is controlled to be increased and the opening degree of the refrigerant flow rate regulating valve 26 is controlled to be decreased.

When the supercooling degree (SC) is lower than the set range, the intermediate expansion valve 25 is controlled to close the flow passage and the refrigerant flow rate regulating valve 26 is controlled to open the flow passage. That is, when the supercooling degree is lower than the set range, the opening degree of the intermediate expansion valve 25 is controlled to be decreased and the opening degree of the refrigerant flow rate regulating valve 26 is controlled to be increased.

When the amount of refrigerant filled in the refrigerant circuit is excessive in a state in which the heating mode is being performed, the supercooling degree of the refrigerant at the outlet side of the heating heat exchanger 22 is increased. Therefore, when the supercooling degree exceeds the set range, the intermediate processor C2 determines that the refrigerant circuit refrigerant amount is excessive, increases the opening degree of the intermediate expansion valve 25, and decreases the opening degree of the refrigerant flow rate regulating valve 26. By this control, the refrigerant in the refrigerant circuit is stored in the cooling heat exchanger 21, which is not used as a heat exchanger in the heating mode. When the excess refrigerant in the refrigerant circuit is stored in the cooling heat exchanger 21, the supercooling degree (SC) is lowered and maintained within the set range.

When the amount of refrigerant filled in the refrigerant circuit is insufficient in a state in which the heating mode is being performed, the supercooling degree of the refrigerant at the outlet side of the heating heat exchanger 22 is decreased. Therefore, when the supercooling degree is lower than the set range, the intermediate processor C2 determines that the refrigerant circuit refrigerant amount is insufficient, decreases the opening degree of the intermediate expansion valve 25, and increases the opening degree of the refrigerant flow rate regulating valve 26. By this control, the refrigerant stored in the cooling heat exchanger 21 is supplied to the refrigerant circuit. When the refrigerant in the cooling heat exchanger 21 is supplied to the refrigerant circuit, the supercooling degree is increased and maintained within the set range.

As described above, the heat pump system 1 calculates the supercooling degree (SC) of the refrigerant at the outlet side of the heating heat exchanger 22, and controls the opening degree of the intermediate expansion valve 25 and the refrigerant flow rate regulating valve 26 so that the calculated supercooling degree is maintained within the set range. The refrigerant flow rate of the refrigerant circuit is controlled and hot air is stably supplied to the heating unit 30H by controlling the opening degree of the intermediate expansion valve 25 and the refrigerant flow rate regulating valve 26 on the basis of the supercooling degree.

In the above embodiments, the outdoor unit 10 and the intermediate unit 20 are accommodated in separate housings, but the outdoor unit 10 and the intermediate unit 20 may be accommodated in a single housing.

The program for realizing the embodiments of the present disclosure may be provided not only by communication means but also by being stored in various recording media such as CD-ROM and the like.

The scope of the present disclosure is not limited to the specific embodiments described above. It should be understood by those of skilled in the art that various changes in form and details may be made without departing from the spirit and scope of the present disclosure.

The invention claimed is:

1. A heat pump system comprising an outdoor unit disposed in an outdoor space, the outdoor unit comprising a four-way valve and an outdoor heat exchanger;

a plurality of thermal load units supplied with cool air and hot air; and an intermediate unit disposed between the outdoor unit and the plurality of thermal load units, wherein the intermediate unit is connected to the outdoor unit through refrigerant pipes through which a refrigerant passes, and connected to the plurality of thermal load units through thermal medium pipes through which a thermal medium passes, and wherein the refrigerant pipes comprise:

a first refrigerant pipe to guide the refrigerant from the four-way valve to the outdoor heat exchanger, a second refrigerant pipe to guide the refrigerant from the four-way valve to a heating heat exchanger, a third refrigerant pipe to connect the first refrigerant pipe and the second refrigerant pipe, and an on-off valve disposed on the third refrigerant pipe to allow the refrigerant to selectively flow through the third refrigerant pipe.

2. The heat pump system according to claim 1, wherein:

the outdoor unit further includes a compressor to compress the refrigerant, the outdoor heat exchanger is configured to allow the refrigerant to heat-exchange with outdoor air, the four-way valve is configured to guide the refrigerant discharged from the compressor to any one of the outdoor heat exchanger and the intermediate unit, and the outdoor unit further includes an outdoor expansion valve to decompress and expand the refrigerant.

3. The heat pump system according to claim 2, wherein:

the intermediate unit further includes a cooling heat exchanger to exchange heat between the thermal medium transferred from a first one of the thermal load units and the refrigerant, the intermediate unit further includes the heating heat exchanger, the heating heat exchanger configured to exchange heat between the thermal medium transferred from a second one of the thermal load units and the refrigerant, and the intermediate unit further includes an intermediate expansion valve to decompress and expand the refrigerant.

4. The heat pump system according to claim 3, further comprising a fourth refrigerant pipe to guide the refrigerant discharged from the compressor to the four-way valve, a fifth refrigerant pipe to guide the refrigerant from the four-way valve to a suction side of the compressor, a sixth refrigerant pipe to guide the refrigerant from the cooling heat exchanger to the suction side of the compressor, and a seventh refrigerant pipe connected to the outdoor heat exchanger and branched into two pieces such that one of the two pieces forms a cooling refrigerant pipe connected to the cooling heat exchanger and the other forms a heating refrigerant pipe connected to the heating heat exchanger.

5. The heat pump system according to claim 3, further comprising a fourth refrigerant pipe to guide the refrigerant from the cooling heat exchanger to a suction side of the compressor, a pressure sensor to detect a pressure at a refrigerant outlet side of the cooling heat exchanger, and a refrigerant flow rate regulating valve disposed on the fourth refrigerant pipe and whose opening degree is controlled such that a pressure detected by the pressure sensor becomes a value within a set range.

6. The heat pump system according to claim 3, further comprising a fourth refrigerant pipe to guide the refrigerant from the cooling heat exchanger to a suction side of the compressor, a cooling temperature sensor to detect a temperature of the thermal medium cooled through the cooling heat exchanger, a refrigerant bypass pipe branched from a cooling refrigerant pipe and connected to the fourth refrigerant pipe, and a bypass expansion valve disposed on the refrigerant bypass pipe to open a flow passage of the refrigerant bypass pipe when a temperature of the thermal medium detected by the cooling temperature sensor is lower than a set threshold value.

7. The heat pump system according to claim 3, further comprising:

a defrost bypass pipe having one end connected to the second refrigerant pipe and another end connecting a suction side of the compressor to a fourth refrigerant pipe, and a refrigerant passage switching valve disposed on the defrost bypass pipe to open a flow passage of the defrost bypass pipe when defrosting is required by the outdoor heat exchanger.

8. The heat pump system according to claim 3, further comprising:

a cooling thermal medium supply pipe to supply the thermal medium cooled in the cooling heat exchanger to the first thermal load unit, a cooling thermal medium recovery pipe to transfer the thermal medium, which has passed through the first thermal load unit and absorbed heat, to the cooling heat exchanger, a heating thermal medium supply pipe to supply the thermal medium cooled in the heating heat exchanger to the second thermal load unit, and a heating thermal medium recovery pipe to transfer the thermal medium, which has passed through the second thermal load unit and radiated heat, to the heating heat exchanger.

9. The heat pump system according to claim 8, further comprising:

a cooling pump disposed on the cooling thermal medium recovery pipe, and a heating pump disposed on the heating thermal medium recovery pipe.

10. The heat pump system according to claim 8, further comprising:

a cooling thermal medium bypass pipe having one end connected to the cooling thermal medium supply pipe and another end connected to the cooling thermal medium recovery pipe, a heating thermal medium bypass pipe having one end connected to the heating thermal medium supply pipe and another end connected to the heating thermal medium recovery pipe, a cooling thermal medium bypass valve disposed on the cooling thermal medium bypass pipe to open and close a flow passage of the cooling thermal medium bypass pipe, and a heating thermal medium bypass valve disposed on the heating thermal medium bypass pipe to open and close a flow passage of the heating thermal medium bypass pipe.

11. The heat pump system according to claim 8, further comprising:

a first connection bypass pipe having one end connected to the heating thermal medium supply pipe and another end connected to the cooling thermal medium recovery pipe, a second connection bypass pipe having one end connected to the cooling thermal medium supply pipe and another end connected to the heating thermal medium recovery pipe, a first connection bypass valve disposed on the first connection bypass pipe to open and close a flow passage of the first connection bypass pipe, and a second connection bypass valve disposed on the second connection bypass pipe to open and close a flow passage of the second connection bypass pipe.

12. The heat pump system according to claim 8, further comprising:

a cooling thermal medium supply valve disposed on the cooling thermal medium supply pipe to regulate an amount of thermal medium supplied to the first thermal load unit, a cooling thermal medium recovery valve disposed on the cooling thermal medium recovery pipe to regulate an amount of thermal medium recovered from the first thermal load unit, a heating thermal medium supply valve disposed on the heating thermal medium supply pipe to regulate an amount of thermal medium supplied to the second thermal load unit, and a heating thermal medium recovery valve disposed on the heating thermal medium recovery pipe to regulate an amount of thermal medium recovered from the second thermal load unit.

13. The heat pump system according to claim 4, further comprising:

a heating refrigerant temperature sensor disposed at a refrigerant outlet side of the heating heat exchanger to detect a temperature of the refrigerant, a heating refrigerant pressure sensor disposed at the refrigerant outlet side of the heating heat exchanger to detect a pressure of the refrigerant, and a refrigerant flow rate regulating valve disposed on the sixth refrigerant pipe and whose opening degree is regulated according to a supercooling degree of the refrigerant outlet side of the heating heat exchanger.

* * * * *